US009127638B2

(12) United States Patent
Shibata et al.

(10) Patent No.: US 9,127,638 B2
(45) Date of Patent: Sep. 8, 2015

(54) CONTROL APPARATUS FOR INTERNAL COMBUSTION ENGINE

(71) Applicant: DENSO CORPORATION, Kariya, Aichi-pref. (JP)

(72) Inventors: Masamichi Shibata, Toyota (JP); Atsuya Mizutani, Nagoya (JP); Yasuomi Imanaka, Obu (JP); Koichi Hattori, Ichinomiya (JP)

(73) Assignee: Denso Corporation, Kariya (JP)

( * ) Notice: Subject to any disclaimer, the term of this patent is extended or adjusted under 35 U.S.C. 154(b) by 394 days.

(21) Appl. No.: 13/757,987

(22) Filed: Feb. 4, 2013

(65) Prior Publication Data

US 2013/0199485 A1 Aug. 8, 2013

(30) Foreign Application Priority Data

Feb. 8, 2012 (JP) ..... 2012-025108
Feb. 8, 2012 (JP) ..... 2012-025110
Sep. 5, 2012 (JP) ..... 2012-195099

(51) Int. Cl.
*F02P 5/00* (2006.01)
*F02P 17/12* (2006.01)
*F02P 3/04* (2006.01)
*F02P 11/06* (2006.01)

(52) U.S. Cl.
CPC ..... *F02P 17/12* (2013.01); *F02P 3/0414* (2013.01); *F02P 11/06* (2013.01)

(58) Field of Classification Search
CPC ..... F02P 17/12; F02P 11/06; F02P 3/0414; F02P 2017/125; F02D 35/021
USPC ..... 123/406.13, 406.14, 406.27, 630, 644; 73/114.08, 114.67
See application file for complete search history.

(56) References Cited

U.S. PATENT DOCUMENTS 4,531,500 A * 7/1985 Burson ..... 123/630
4,969,443 A * 11/1990 DeBiasi ..... 123/481
5,503,132 A * 4/1996 Miyata et al. ..... 123/630

(Continued)

FOREIGN PATENT DOCUMENTS

JP A-61-178561 8/1986
JP S63-94080 A 4/1988

(Continued)

OTHER PUBLICATIONS

Apr. 28, 2015 Notification of Reasons for Rejection issued in Japanese Patent Application No. 2012-195099.

(Continued)

*Primary Examiner* — Thomas Moulis
*Assistant Examiner* — Joseph Dallo
(74) *Attorney, Agent, or Firm* — Oliff PLC

(57) ABSTRACT

A control apparatus for an ignition system of an internal combustion engine which can appropriately judge deterioration of a spark plug is disclosed. The ignition system includes a spark plug and a Zener diode. These are connected in parallel. In the ignition system, a constant-voltage path whose one of two ends is grounded is connected to the connecting path which connects the center electrode of the spark plug to a secondary coil. The constant-voltage path includes a Zener diode and a resistor. In a case where electric current is detected at the resister in a term from the start of current supply to a primary coil to the end, the control apparatus judges the spark plug being deteriorated.

19 Claims, 14 Drawing Sheets

(56) References Cited

U.S. PATENT DOCUMENTS

| | | | | |
|---|---|---|---|---|
| 5,701,077 | A * | 12/1997 | Inagaki | 324/399 |
| 6,920,783 | B2 * | 7/2005 | Kesler | 73/114.08 |
| 7,559,319 | B2 * | 7/2009 | Idogawa et al. | 123/652 |
| 2002/0000809 | A1 * | 1/2002 | Karau et al. | 324/380 |
| 2004/0083717 | A1 * | 5/2004 | Zhu et al. | 60/284 |
| 2004/0084018 | A1 * | 5/2004 | Zhu et al. | 123/406.14 |
| 2004/0084019 | A1 * | 5/2004 | Zhu et al. | 123/406.21 |
| 2004/0084020 | A1 * | 5/2004 | Daniels et al. | 123/406.23 |
| 2004/0084026 | A1 * | 5/2004 | Zhu et al. | 123/435 |
| 2004/0084035 | A1 * | 5/2004 | Newton | 123/630 |
| 2004/0088102 | A1 * | 5/2004 | Daniels et al. | 701/108 |
| 2005/0134281 | A1 * | 6/2005 | Zhu et al. | 324/380 |
| 2006/0027211 | A1 * | 2/2006 | Naruse et al. | 123/406.14 |
| 2006/0152865 | A1 * | 7/2006 | Nair et al. | 361/35 |
| 2006/0174858 | A1 * | 8/2006 | Kojima et al. | 123/630 |
| 2007/0017493 | A1 * | 1/2007 | Dufour | 123/638 |
| 2007/0186902 | A1 * | 8/2007 | Zhu et al. | 123/406.34 |
| 2007/0186903 | A1 * | 8/2007 | Zhu et al. | 123/406.37 |
| 2011/0031979 | A1 * | 2/2011 | Gillberg et al. | 324/546 |
| 2013/0199510 | A1 | 8/2013 | Shibata et al. | |
| 2013/0200816 | A1 | 8/2013 | Shibata et al. | |

FOREIGN PATENT DOCUMENTS

| | | |
|---|---|---|
| JP | B2-6-80313 | 10/1994 |
| JP | A-2013-177888 | 9/2013 |
| JP | A-2014-077432 | 5/2014 |

OTHER PUBLICATIONS

Apr. 28, 2015 Notification of Reasons for Rejection issued in Japanese Patent Application No. 2012-025110.

* cited by examiner

ON
IGt
OFF

If-DETECTED PERIOD
INTENSITY
BRAND NEW
PERIOD OF USE = SHORT
0
V2
PERIOD OF USE = LONG
-Vz

INTENSITY
PERIOD OF USE = LONG
If
0
PERIOD OF USE = SHORT
t1
t2
t3
t4
t5
t6
t7

IGt
ON
OFF
OFF

INTENSITY
I1

INTENSITY
Vmax
V1
Vmin

INTENSITY
0
V2
−Vz

NORMAL
INTENSITY
I2
Iα

INTENSITY
FAILURE OCCURS
Is
0
NORMAL「1」

1
F
(FLAG)
0
FAILURE OCCURS「0」
t1
t2
t3
t4

FIG.13
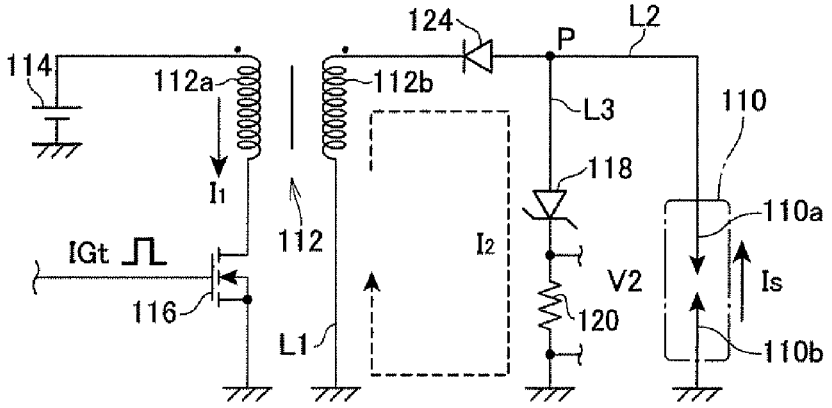
FIG.14A
FIG.14B
FIG.14C
FIG.14D
FIG.14E
FIG.14F
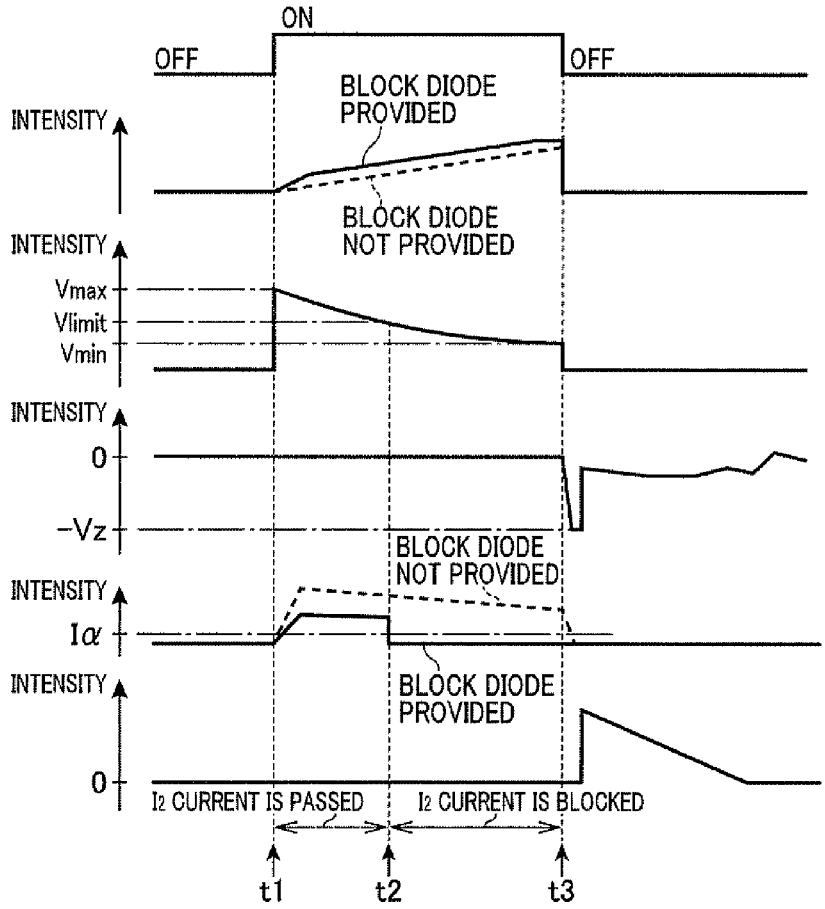

CONTROL APPARATUS FOR INTERNAL COMBUSTION ENGINE

CROSS-REFERENCE TO RELATED APPLICATION

This application is based on and claims the benefit of priorities from earlier Japanese Patent Application Nos. 2012-025108, 2012-025110 and 2012-195099 filed Feb. 8, 2012, Feb. 8, 2012 and Sep. 5, 2012, respectively, the descriptions of which are incorporated herein by reference.

BACKGROUND OF THE INVENTION

1. Technical Field of the Invention

The present invention relates to a control apparatus for an internal combustion engine, which performs ignition control under which high voltage is applied across the electrodes of a spark plug based on electro-magnetic energy stored in a spark coil to produce discharge sparks across the electrodes and, in particular, to a control apparatus for an internal combustion engine, which is able to appropriately determine deterioration as being caused in the spark plug or determine the occurrence of an open failure in an ignition system. Herein, "open failure" means a defective state such that electrical wiring of the circuit is cut thereby the circuit has become opened.

2. Related Art

Due to the recent trend of downsizing vehicles for the purposes of fuel consumption improvement and cost reduction, there is a tendency of using a supercharger to increase a compression ratio in a spark-ignition internal combustion engine (gasoline engine). A high compression ratio raises an in-cylinder pressure (pressure in a cylinder) in a period in which discharge sparks are produced in a gap between a center electrode and a ground electrode of a spark plug. Thus, the spark plug will have high discharge voltage. When the discharge voltage becomes high under the conditions where the electrodes' wear in the spark plug is advanced due to the increase of a running distance or the like, the discharge voltage may exceed an insulation-breakdown threshold voltage of a plug insulator at an early stage, impairing reliability of the spark plug. As a result, discharge sparks would no longer be produced, which may lead to the occurrence of an accidental fire in the internal combustion engine.

In order to cope with this problem, the inventors of the present application paid attention to a technique being disclosed in JP-B-H06-080313. In this technique, a constant-voltage element such as a Zener diode or a Varistor is used in order to restrict the discharge voltage of a spark plug to a predetermined voltage. Specifically, one of two ends of a spark coil is connected to a constant-voltage element that allows a current to pass therethrough when a voltage between a center electrode and a terminal of a spark plug becomes equal to or higher than the predetermined voltage. One of two ends of the constant-voltage element is connected to the center electrode of the spark plug, and anther end is grounded.

According to this configuration, when a voltage applied to the gap of the spark plug is about to exceed the predetermined voltage, the applied voltage is restricted to the predetermined voltage and flattened. Thus, the conditions of the gas in the gap are made suitable for discharge in a period when the applied voltage is maintained at the predetermined voltage, thereby allowing discharge sparks to occur in the gap. With this configuration, the discharge voltage of the spark plug is prevented from becoming excessively high and thus the reliability of the spark plug can be maintained.

As the duration of use of a spark plug becomes longer, the degree of deterioration of the spark plug becomes higher. For example, the gap of the spark plug may be enlarged with the advancement of electrodes' wear of the spark plug. In an ignition system including a constant-voltage element, a higher degree of deterioration of the spark plug means that a longer time is taken accordingly from when the voltage applied to the gap reaches the predetermined voltage until when the conditions of the gas in the gap are made suitable for discharge. Since the electro-magnetic energy stored in the spark coil is finite, the higher deterioration of the spark plug may prevent the conditions of the gas in the gap from becoming suitable for discharge in the period when the voltage applied to the gap is maintained to the predetermined voltage. In this case, discharge sparks are no longer produced, leading to the occurrence of an accidental fire in the internal combustion engine. In order to avoid such a situation, a technique for detecting deterioration of a spark plug is sought for.

For example, an open failure may occur in the constant-voltage element. Specifically, an open failure may occur in an electric path (hereinafter referred to as "constant-voltage path") extending toward the constant-voltage element from an electric path connecting between the secondary coil and the center electrode. If an open failure occurs, the constant-voltage element loses its function of restricting the voltage applied to the gap. Accordingly, the voltage applied to the gap may exceed an allowable upper limit (upper-limit withstand voltage). This may impair the reliability of the ignition system including the spark plug. In order to avoid such a situation, a technique for detecting an open failure of the constant-voltage path is sought for.

SUMMARY

In light of the conditions as set forth above, it is desired to provide a control apparatus for an internal combustion engine, which is able to appropriately determine deterioration as being caused in a spark plug or determine whether an open failure has occurred in a constant-voltage path.

The present invention provides, as a typical example, a control apparatus for an internal combustion engine, the apparatus including a spark coil having a primary coil and a secondary coil being electro-magnetically connected to the primary coil, and a spark plug that produces discharge sparks in between its center electrode and its ground electrode by applying a high voltage across both electrodes on the basis of the electro-magnetic energy stored in the spark coil.

In the apparatus, one of two ends of the secondary coil is connected to a member having a standard electric potential of the control apparatus via a low-voltage side path, and another end of the secondary coil is connected to the center electrode via a connecting path. Further, in the apparatus, one of two ends of a constant-voltage path is connected to the connecting path while another end of the constant-voltage path is grounded. Both ends of the constant-voltage path may be connected to a secondary coil.

The constant-voltage path includes a constant-voltage element and a current detecting means. When current is supplied to the primary coil, the constant-voltage element allows current to flow through the constant-voltage path in a specified direction that permits the polarity of the inductive voltage generated in the secondary coil to turn from negative to positive. When current supplied to the primary coil is cut off and the voltage applied across the terminals of the element becomes equal to or higher than a specified voltage, the constant-voltage element allows current to flow through the constant-voltage path in a direction opposite to the specified direction, at the same time, decreasing voltage corresponds to the level of the specified voltage. The current detecting means detects a current passing through the constant-voltage path.

The apparatus further includes a deterioration judging means that determines deterioration as being caused in the spark plug based on the fact that a period in which current is detected by the current detecting means has become longer than a standard period (first aspect of the control apparatus for an internal combustion engine of the present invention).

The inventors of the present invention have paid attention to the fact that, when a voltage applied to a gap between the center electrode and the ground electrode of the spark plug is about to exceed the specified voltage, current flows through the constant-voltage path in a period in which the voltage applied to the gap is restricted to the specified voltage. The inventors found that the period in which current flows through the constant-voltage path tends to be longer as the degree of deterioration, such as enlargement of the gap, of the spark plug becomes higher. In light of this, the above configuration includes the deterioration judging means to appropriately determine deterioration as being caused in the spark plug.

The specified voltage may preferably be set to a voltage higher than a discharge voltage of the spark plug which is brand new. Further, the deterioration judging means may preferably determine deterioration as being caused in the spark plug on the basis of the fact that current has been detected by the current detecting means (second aspect of the control apparatus for an internal combustion engine of the present invention).

With this configuration, the voltage applied to the gap comes to be restricted to the specified voltage when the degree of deterioration of the spark plug becomes higher and the discharge voltage of the spark plug becomes higher. Thus, deterioration of the spark plug is determined on the basis of the fact that current has been detected by the current detecting means.

The present invention provides, as a second typical example, a control apparatus for an internal combustion engine, the apparatus including a current detecting means and an open failure judging means. The current detecting means is disposed inside or outside the constant-voltage path to detect current passing through the constant-voltage path in the specified direction when current is supplied to the primary coil. The open failure judging means determines the occurrence of an open failure in the constant-voltage path on the basis of the fact that no current has been detected by the current detecting means when current is supplied to the primary coil (third aspect of the control apparatus for an internal combustion engine of the present invention).

The inventors of the present invention have paid attention to the fact that current is passed through a closed loop circuit that includes the secondary coil and the constant-voltage path. The current is caused by the inductive voltage generated in the secondary coil when current is supplied to the primary coil. The inventors had a finding that, when an open failure occurs in the constant-voltage path, the closed loop circuit is not formed and thus no current is passed through the constant-voltage path.

In light of such a finding, the above configuration includes the current detecting means as set forth above. The occurrence of an open failure can be appropriately determine as being caused based on the fact that no current is determined to be detected by the current detecting means under the conditions where current is supplied to the primary coil.

The apparatus may preferably include a restricting element. When current is supplied to the primary coil, the restricting element blocks the current to be passed through the constant-voltage path in the specified direction when the voltage across the terminals of the element becomes smaller than a threshold voltage, and allows the current to pass through the constant-voltage path in the specified direction when the voltage across the terminals becomes equal to or larger than the threshold voltage. When the current supplied to the primary coil is cut off, the restricting element allows current to pass through the constant-voltage path in a direction opposite to the specified direction. The threshold voltage may preferably be set to a voltage smaller than a maximum value of the voltage applied across the terminals of the restricting element when current is supplied to the primary coil, but larger than zero (fourth aspect of the control apparatus for an internal combustion engine of the present invention).

Through experiments, the inventors of the present invention had a finding that the discharge voltage of the spark plug is prevented from becoming excessively high by providing a constant-voltage element in the constant-voltage path, but that the inductive voltage generated in the secondary coil becomes lower than expected. In this case, for example, no discharge sparks are produced across the electrodes of the spark plug and thus an accidental fire may be caused in the engine. In this regard, the inventors also had a finding that provision of the restricting element in the ignition system can suppress decrease of the inductive voltage which is generated in the secondary coil when current supplied to the primary coil is cut off. This finding is based on the following grounds.

When current is supplied to the primary coil in an ignition system that includes no restricting element, the inductive voltage generated in the secondary coil allows current to pass through the closed loop circuit. When current passes through the closed loop circuit, the current passing through the primary coil decreases to decrease the electro-magnetic energy stored in the spark coil. The decrease of the electro-magnetic energy decreases the inductive voltage which is generated in the secondary coil when the current supplied to the primary coil is cut off. This is when the voltage applied across the electrodes of the spark plug is lowered, resulting in that, for example, discharge sparks are no longer produced across the electrodes of the spark plug.

From the viewpoint of enhancing the effect of suppressing the decrease of the electro-magnetic energy stored in the spark coil, the current that passes through the closed loop circuit when current is supplied to the primary coil may be blocked. However, from the viewpoint of determining the occurrence of an open failure in the constant-voltage path by the open failure judging means, the current that passes through the closed loop circuit when current is supplied to the primary coil cannot be blocked.

In light of these points, the threshold voltage of the restricting element may be set. Thus, while restricting current flowing in the specified direction when current is supplied to the primary coil, whether an open failure has occurred in the constant-voltage path can be determined. In this way, the present configuration is able to suppress the decrease of the inductive voltage which is generated in the secondary coil when the current supplied to the primary coil is cut off and thus suppress the decrease of the voltage applied across the electrodes of the spark plug. Accordingly, the discharge sparks will reliably be produced across the electrodes of the spark plug. In other words, discharge sparks are necessarily produced across the electrodes of the spark plug, resultantly avoiding the occurrence of an accidental fire in the engine.

The constant-voltage element may be comprised of a diode that causes Zener breakdown or Avalanche breakdown when the voltage applied across the terminals of the element becomes equal to the specified voltage (fifth aspect of the control apparatus for an internal combustion engine of the present invention).

BRIEF DESCRIPTION OF THE DRAWINGS

In the accompanying drawings:

FIG. 13 is a schematic diagram illustrating an ignition system, according to a sixth embodiment of the present invention;

FIGS. 14A to 14F are timing diagrams illustrating signals and voltages involved in a failure determination process, according to the sixth embodiment;

DETAILED DESCRIPTION OF THE PREFERRED EMBODIMENTS

With reference to the accompanying drawings hereinafter are described several embodiments of the present invention.

First Embodiment

Referring to FIGS. 1 to 4 and FIGS. 5A to 5C first, hereinafter is described a first embodiment in which a control apparatus of the present invention is applied to a combustion control system of an on-vehicle internal combustion engine (gasoline engine).

Figure 1:
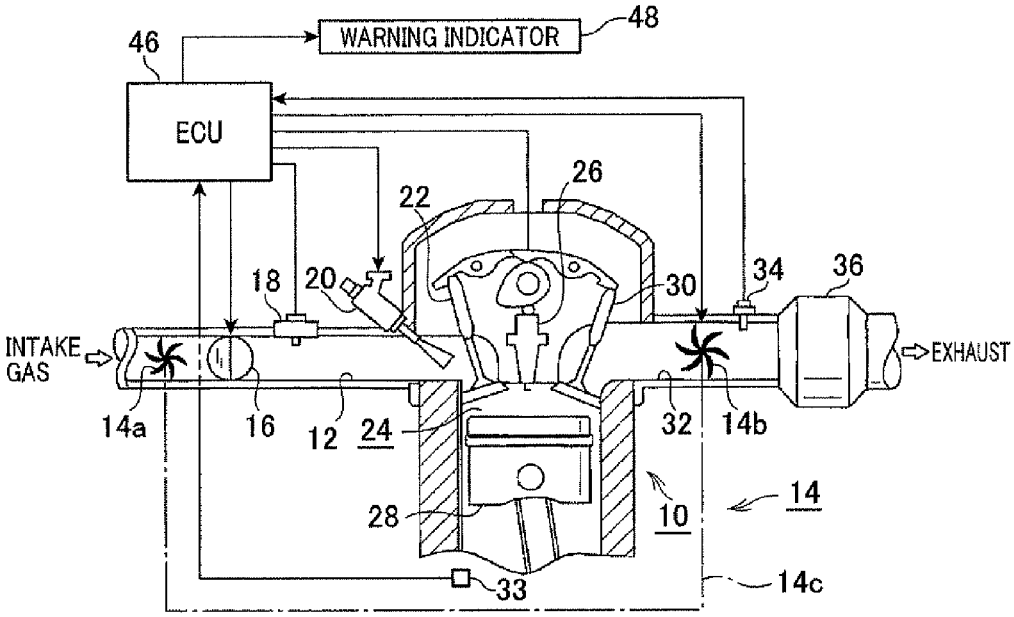
FIG. 1 is a schematic diagram illustrating a combustion control system, according to a first embodiment of the present invention.

FIG. 1 is a schematic diagram generally illustrating the combustion control system according to the first embodiment. As shown in FIG. 1, the combustion control system includes an engine 10 which is provided with an intake path 12. The intake path 12 includes, from its upstream side toward its downstream side, an intake compressor 14*a* provided in a turbocharger 14 described later, a throttle valve 16 and an intake pressure sensor 18 that detects a pressure (intake pressure) in the intake path 12. The throttle valve 16 is an electronically controlled member that regulates a quantity of air (air content or intake volume). Specifically, the opening of the throttle valve 16 (throttle position) is electronically controlled to regulate the quantity of air supplied to a combustion chamber 24 of the engine 10.

The intake path 12 is provided with an electromagnetically-driven fuel injection valve 20 in the vicinity of an intake port which is located downstream of the intake pressure sensor 18. The fuel injection valve 20 injects and supplies fuel that has been pumped up from a fuel tank, not shown, to the vicinity of the intake port. Air-fuel mixture, i.e. a gas in which the fuel injected and supplied from the fuel injection valve 20 is mixed with an intake air, is supplied to the combustion chamber 24 with an opening motion of an intake valve 22.

The air-fuel mixture supplied to the combustion chamber 24 is ignited and combusted by the discharge sparks produced by a spark plug 26 whose end portion (that includes a center electrode and a ground electrode) is projected into the combustion chamber 24. The energy generated with the combustion of the air-fuel mixture is taken out, via a piston 28, as rotation energy used for rotating an output shaft (crank shaft) of the engine 10. The combusted air-fuel mixture is emitted in the form of an exhaust gas into an exhaust path 32 with an opening motion of an exhaust valve 30. The crank shaft is provided, in its vicinity, with a crank-angle sensor 33 that senses a rotation angle of the crank shaft.

The turbocharger 14 mentioned above is arranged between the intake path 12 and the exhaust path 32. The turbocharger 14 includes the intake compressor 14*a* mentioned above, an exhaust turbine 14*b* arranged in the exhaust path 32, and a rotary shaft 14*c* connecting between the intake compressor 14*a* and the exhaust turbine 14*b*. Specifically, the exhaust turbine 14*b* is rotated by the energy of the exhaust gas flowing through the exhaust path 32. The rotation energy of the exhaust turbine 14*b* is transmitted to the intake compressor 14*a* via the rotary shaft 14*c* so that intake air is compressed by the intake compressor 14*a*. In other words, intake air is supercharged by the turbocharger 14. In the present embodiment, the turbocharger 14 is able to control the supercharging pressure of intake air. For example, the turbocharger 14 is able to control the supercharging pressure by controlling the opening of a variable vane, not shown, of the turbocharger 14.

At downstream of the exhaust turbine 14*b*, the exhaust path 32 is provided with an A/F sensor 34 and a three-way catalyst 36 which are positioned in this order from upstream to downstream. The A/F sensor 34 outputs linear electrical signals according to an oxygen concentration or unburned components (e.g., CO, HC and $H_2$) of an exhaust gas. Specifically, the A/F sensor 34 is what is called a "full-range air-fuel ratio sensor" which is able to detect an air-fuel ratio in a wide range. The three-way catalyst 36 has a function of cleaning harmful components in an exhaust gas.

Figure 2:
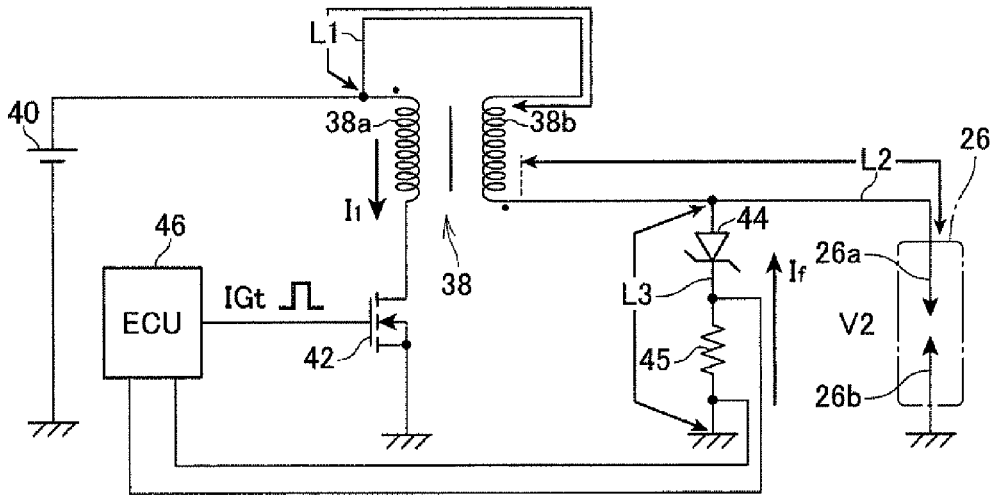
FIG. 2 is a schematic diagram illustrating an ignition system, according to the first embodiment.

Referring to FIG. 2, hereinafter is specifically described a configuration of an ignition system of the first embodiment. FIG. 2 is a schematic diagram generally illustrating the ignition system of the first embodiment. As shown in FIG. 2, the ignition system includes a spark coil (ignition coil) 38, a spark plug 26, a battery 40, a switching element 42 and an electronic control unit (ECU) 46. The spark coil 38 includes a primary coil 38*a* and a secondary coil 38*b* which is electro-magnetically connected to the primary coil 38*a*. The spark plug 26 includes a center electrode 26*a* and a ground electrode 26*b*. The secondary coil 38*b* has two ends, one of which is connected to the side positive terminal of the battery 40 (corresponding to the member having a standard electric potential) via a low-voltage side path L1. Another end of the secondary coil 38*b* is connected to the center electrode 26*a* of the spark plug 26 via a connecting path L2. The battery 40 has a negative terminal being grounded. In the present embodiment, the battery 40 is a lead battery having a terminal voltage of 12 V. Also, in the present embodiment, a ground potential is 0 V.

The primary coil 38*a* has two ends, one of which is connected to the positive terminal of the battery 40, while another end is grounded via an input/output terminal of the switching element 42 that is an electronically controlled opening/closing means. In the present embodiment, the switching element 42 is an N-channel MOSFET (metal-oxide semiconductor field-effect transistor).

The connecting path L2 is connected to a constant-voltage path L3. The constant-voltage path L3 is provided with a Zener diode 44 and a resistor 45 therein which are positioned in this order from a connecting path L2 side. One of two ends of the constant-voltage path L3 is connected to a grounding portion. The Zener diode 44 serves as a constant-voltage element, while the resistor 45 is used for detecting current. Specifically, an anode of the Zener diode 44 is connected to a connecting path L2 and a cathode is connected to the resistor 45.

The ECU 46 is mainly configured as a microcomputer to serve as a control means for controlling the engine 10. The ECU 46 detects a current passing through the resistor 45 on the basis of the amount of voltage drop in the resistor 45. Also, the ECU 46 carries out ignition control under which the ECU 46 outputs an ignition signal IGt to an opening/closing control terminal (gate) of the switching element 42 to produce discharge sparks in a gap between the center electrode 26*a* and the ground electrode 26*b* of the spark plug 26.

Specifically, under the ignition control, the ECU 46 outputs an ignition signal IGt to the gate of the switching element 42 to bring the switching element 42 into an on-state (hereinafter this ignition signal is referred to as "on-ignition signal IGt"). As a result, current (primary current $I_1$) is started to be passed to the primary coil 38*a* from the battery 40 to thereby start storage of electro-magnetic energy in the spark coil 38. In the present embodiment, when current is supplied to the primary coil 38*a*, polarity is positive at one of two ends of the secondary coil 38*b*, which is connected to a center electrode 26*a*, and polarity is negative at another end, which is connected to a primary coil 38*a*.

After current is supplied to the primary coil 38*a*, the on-ignition signal IGt is switched to an ignition signal that brings the switching element 42 into an off-state (hereinafter this ignition signal is referred to as "off-ignition signal IGt"). Then, the polarities at both ends of the secondary coil 38*b* are reversed and, at the same time, high voltage is induced in the secondary coil 38*b*. Thus, a high voltage is applied to the gap of the spark plug 26.

In the first embodiment, the constant-voltage path L3 is provided with the Zener diode 44 as mentioned above. Therefore, when a voltage (secondary voltage V2) applied to the gap of the spark plug 26 is about to exceed a breakdown voltage Vz of the Zener diode 44, a voltage drop corresponding to the level of the breakdown voltage Vz occurs in the Zener diode 44 and thus the secondary voltage V2 is restricted to the breakdown voltage Vz. In other words, the secondary voltage V2 is retained to the level of the breakdown voltage Vz in a period in which the secondary voltage V2 is about to exceed the breakdown voltage Vz.

The conditions of the gas in the gap become suitable for discharge in the period in which the secondary voltage V2 is retained to the level of the breakdown voltage Vz. When the suitable conditions of the gas are met, discharge sparks are produced in the gap of the spark plug 26, while a discharge current is permitted to flow from the ground electrode 26*b* to the center electrode 26*a*. With this configuration, discharge voltage of the spark plug 26 is prevented from being increased.

In the present embodiment, the breakdown voltage Vz of the Zener diode 44 is set to be higher than the discharge voltage of a brand-new spark plug 26, higher than a maximum discharge voltage that the brand-new spark plug 26 is expected to generate when the engine 10 is in operation, and lower than an allowable upper limit (upper-limit withstand voltage) of the discharge voltage of the spark plug 26. The upper-limit withstand voltage here refers, for example, to an upper limit of the discharge voltage, which can maintain the reliability of the ignition system. This way of determining the breakdown voltage Vz is based on an idea of preventing the discharge voltage of the spark plug 26 from becoming excessively high due to the aged deterioration of the spark plug 26. In other words, although the discharge voltage of the spark plug 26 is low at the initial use, the discharge voltage will increase as the period of use of the spark plug 26 becomes longer and the degree of deterioration of the spark plug 26 becomes higher accordingly.

Figure 3:
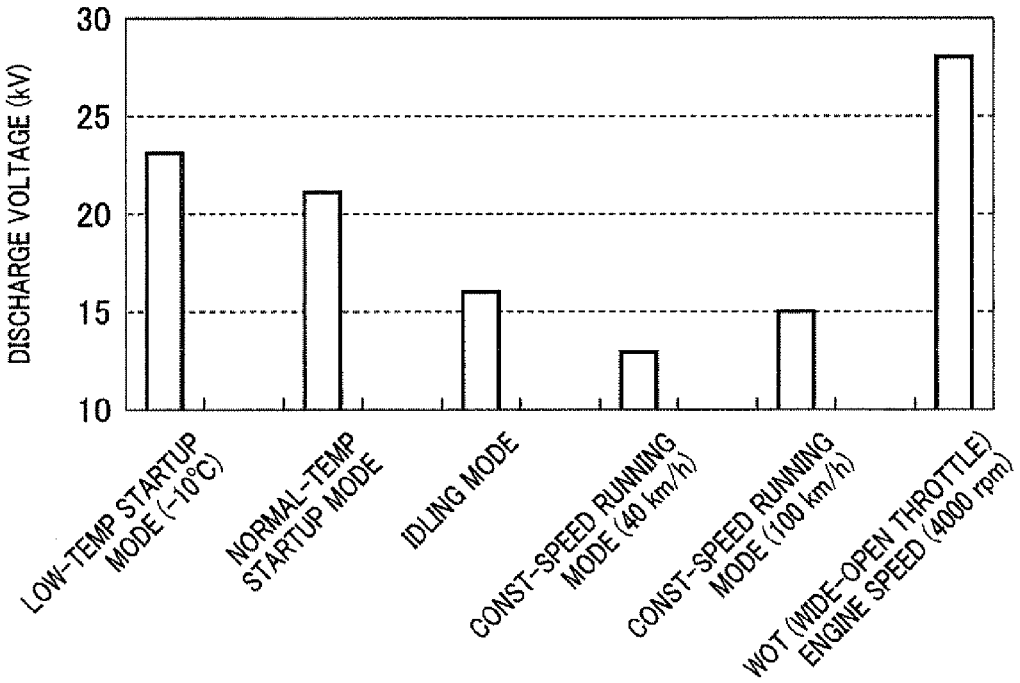
FIG. 3 is a diagram illustrating a relationship between operating conditions of an engine and discharge voltage of a spark plug.

For example, the maximum discharge voltage is determined based on the results of experiments which are conducted by variously changing the operating conditions of the engine 10 (see FIG. 3).

Referring to FIG. 1 again, the output signals derived such as from the intake pressure sensor 18, the crank angle sensor 33 and the A/F sensor 34 are inputted to the ECU 46. Based on the signals inputted from the sensors, the ECU 46 controls fuel injection by the fuel injection valve 20, combustion control of the engine 10 such as supercharging pressure control by the turbocharger 14, and display control over a warning indicator 48, in addition to the ignition control mentioned above.

The fuel injection control is conducted as follows. Specifically, in the control, a basic fuel injection period is determined, first, on the basis such as of an engine speed and an intake pressure. The engine speed is calculated from an output value derived from the crank angle sensor 33. The intake pressure is calculated from an output value derived from the intake pressure sensor 18. As the fuel injection period becomes longer, the quantity of fuel injected from the fuel injection valve 20 tends to be increased. Secondly, a correction coefficient is calculated. The correction coefficient is used for performing feedback control under which an air-fuel ratio of the air-fuel mixture, which is calculated from an output value derived from the A/F sensor 34, is fed back to a target air-fuel ratio (e.g., theoretical air-fuel ratio). Then, the basic fuel injection period is multiplied by the correction coefficient to calculate a command (i.e., value) for a final fuel injection period. Based on the command, the fuel injection valve 20 is supplied with current and manipulated. As a result, a fuel suitable for the command is injected from the fuel injection valve 20.

The supercharging pressure control is conducted as follows. Specifically, a target supercharging pressure is determined, first, on the basis of the operating conditions of the engine 10. Then, the turbocharger 14 is supplied with current and manipulated to control the pressure (supercharging pressure) detected by the intake pressure sensor 18 to be the target supercharging pressure.

Figure 4:
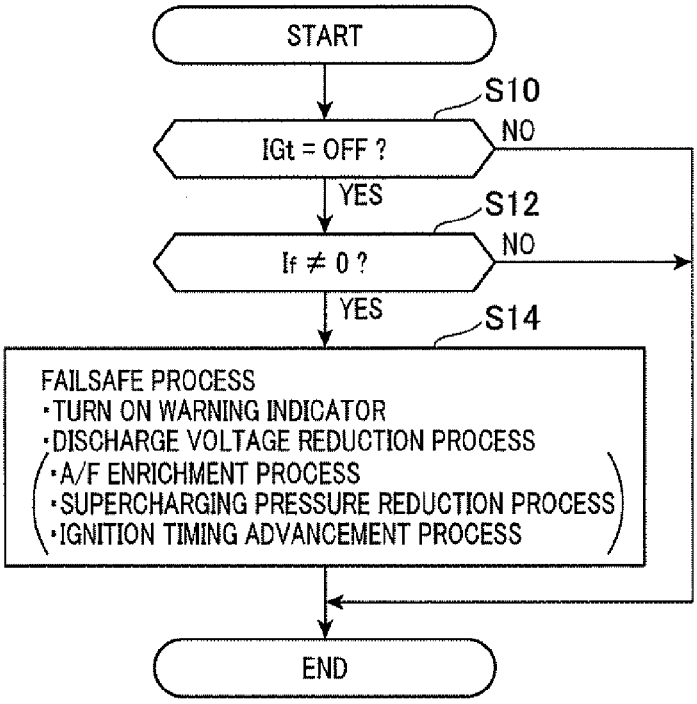
FIG. 4 is a flow diagram illustrating a deterioration determination process conducted of a spark plug, according to the first embodiment.

Referring now to FIG. 4, hereinafter is described a deterioration determination process according to the first embodiment. FIG. 4 is a flow diagram illustrating a series of steps of the process. This process is performed by the ECU 46.

First, at step S10, the ECU 46 determines whether or not the ignition signal IGt is an off-ignition signal. This step is performed to determine whether or not the ignition system is in a state where current can pass through the constant-voltage path L3.

If an affirmative determination is made at step S10, control proceeds to step S12. At step S12, the ECU 46 determines whether or not the current (determination current If) passed through the resistor 45 has a value other than zero, i.e. whether or not current is passed through the constant-voltage path L3. This step is performed to determine whether or not deterioration is caused in the spark plug 26. Specifically, in the present embodiment, the breakdown voltage Vz of the Zener diode 44 is determined in a manner as described above. Therefore, when the period of use of the spark plug 26 is short and thus the degree of deterioration is low in the spark plug 26, discharge voltage of the spark plug 26 will become lower than the breakdown voltage Vz. Accordingly, when the degree of deterioration is low in the spark plug 26, no current will pass through the constant-voltage path L3 in the period in which the off-ignition signal IGt is outputted (hereinafter referred to as "off-ignition-signal period").

On the other hand, when the period of use of the spark plug 26 becomes long and thus the degree of deterioration becomes high in the spark plug 26, the discharge voltage of the spark plug 26 will be increased. In this case, the discharge voltage is restricted to the breakdown voltage Vz. Resultantly, current is passed through the constant-voltage path L3 in the period in which the discharge voltage is restricted to the breakdown voltage Vz. In other words, the time taken for the resistor 45 to detect current becomes longer than zero (standard period).

If an affirmative determination is made at step S12, the ECU 46 determines that the spark plug 26 is deteriorated and control proceeds to step S14. At step S14, a failsafe process is performed. The failsafe process includes a notification process and a discharge voltage reduction process. In the notification process, the user is informed of the deterioration of the spark plug 26. In the discharge voltage reduction process, a control variable of a combustion-control actuator is changed such that the discharge voltage of the spark plug 26 is reduced. For example, the notification process may be carried out by lighting a warning indicator 48 to inform the user of the deterioration. The discharge voltage reduction process may be carried out in the form of an A/F enrichment process, a supercharging pressure reduction process or an ignition timing advancement process.

In the A/F enrichment process, a target air-fuel ratio is shifted to a rich side to increase the quantity of fuel injected from the fuel injection valve 20. This process is performed in light of the fact that a lower air-fuel ratio of the air-fuel mixture can realize a lower discharge voltage in the spark plug 26.

In the supercharging pressure reduction process, a target supercharging pressure of the turbocharger 14 is reduced. This process is performed in light of the fact that a lower pressure in a cylinder (in-cylinder pressure) can realize a lower discharge voltage in the spark plug 26.

In the ignition timing advancement process, the timing of producing discharge sparks in the gap of the spark plug 26 is advanced with respect to a compression top dead center. This process is performed in light of the fact that earlier timing of producing discharge sparks with respect to a compression top dead center can realize a lower in-cylinder pressure and thus can realize a lower discharge voltage in the spark plug 26.

If a negative determination is made at step S10 or S12, or when the failsafe process at step S14 is completed, the series of steps is temporarily terminated.

Usually, the deterioration of the spark plug 26 is considered not to be advanced in a short time. Therefore, the deterioration determination process may be conducted every time the vehicle runs a specified distance, or every time the vehicle's running time elapses a specified time.

In spite of the fact that the degree of deterioration is low in the spark plug 26, some factors may trigger the resistor 45 to detect a current in the off-ignition-signal period, thereby erroneously determining deterioration as being caused the spark plug 26. For example, in order to avoid such a situation, deterioration of the spark plug 26 may be determined as being caused in the case where current is detected by the resistor 45 in a plurality of off-ignition-signal periods.

Figure 5A:
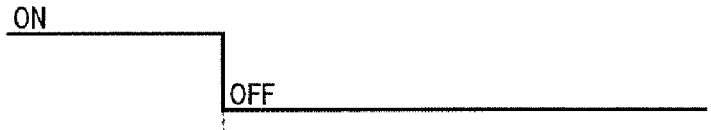
FIGS. 5A to 5C are timing diagrams illustrating signals and voltages involved in the deterioration determination process conducted of a spark plug, according to the first embodiment.
Figure 5B:
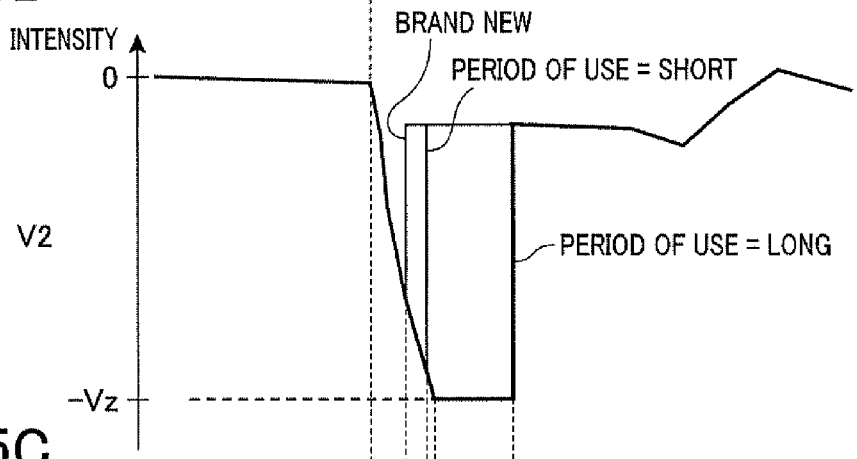
Figure 5C:
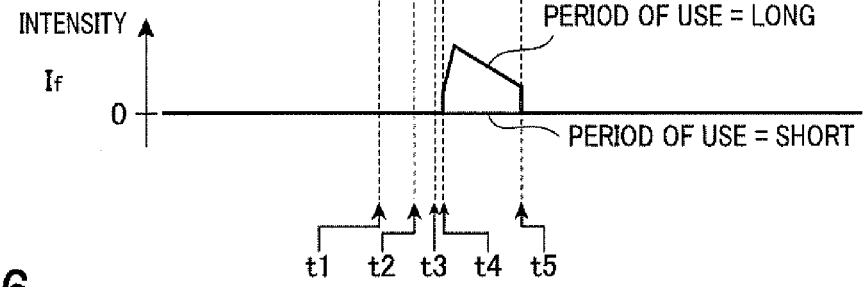

FIGS. 5A to 5C show an example of the deterioration determination process according to the first embodiment. FIG. 5A shows transition of the ignition signal IGt. FIG. 5B shows transition of the secondary voltage V2. FIG. 5C shows transition of the determination current If. It should be appreciated that the determination current If that passes through the constant-voltage path L3 from its grounding side toward a connecting path L2 is defined to be positive.

In the example shown in FIGS. 5A to 5C, the secondary voltage V2 stars to increase from time t1 when the on-ignition signal IGt is switched to the off-ignition signal IGt. If the spark plug 26 is brand new, discharge sparks are produced in the gap at time t2 before the discharge voltage of the spark plug 26 reaches the breakdown voltage Vz of the Zener diode 44.

When the period of use of the spark plug 26 becomes longer, the discharge voltage of the spark plug 26 becomes higher accordingly. The timing when discharge sparks are produced in this case is indicated at time t3 in the figures.

When the period of use of the spark plug 26 becomes much longer, the discharge voltage of the spark plug 26 will be about to exceed the breakdown voltage Vz. Accordingly, the resistor 45 detects the determination current If at time t4 when the secondary voltage V2 begins to be retained to the level of the breakdown voltage Vz. Thus, the ECU 46 determines that the spark plug 26 is deteriorated.

As described above, in the first embodiment, the ECU 46 determines deterioration as being caused in the spark plug 26 when a current is determined to be detected by the resistor 45 in the off-ignition-signal period. Then, if deterioration is determined as being caused, the failsafe process is conducted. Thus, the vehicle can be appropriately driven in a limp-home mode until it reaches a repair shop, or the spark plug 26 can be replaced as promptly as possible, or an accidental fire is favorably suppressed from occurring in the engine 10.

Second Embodiment

Figure 6:
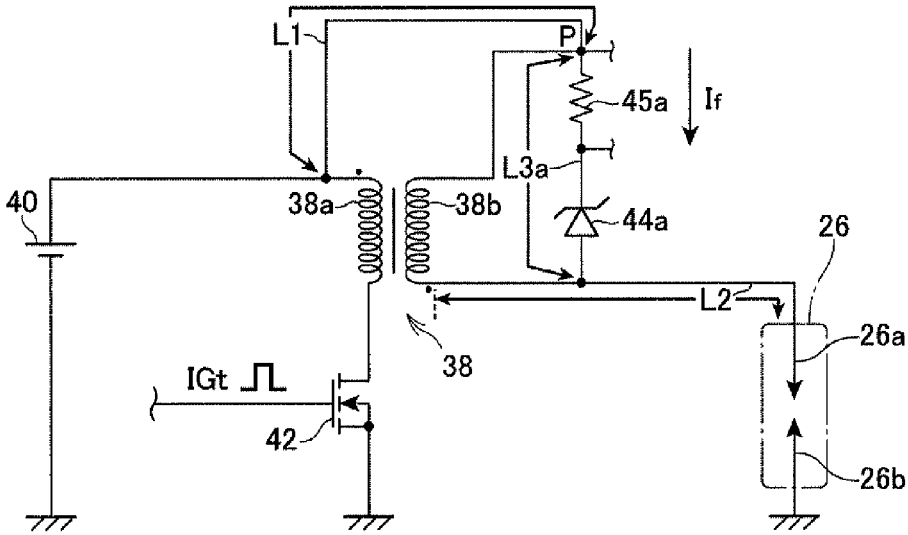
FIG. 6 is a schematic diagram illustrating an ignition system according to a second embodiment of the present invention.

Referring now to FIG. 6, hereinafter is described a second embodiment of the present invention, focusing on the differences from the first embodiment. In the second and the subsequent embodiments as well as the modifications, the components identical with or similar to those in the first embodiment are given the same reference numerals for the sake of omitting unnecessary explanation.

FIG. 6 is a schematic diagram generally illustrating an ignition system according to the second embodiment. FIG. 6 omits the illustration of the ECU 46.

As shown in FIG. 6, in the second embodiment, one of two ends of the low-voltage side path L1, which is shown as a point "P" being connected to a secondary coil 38*b*, is connected to the connecting path L2 via a constant-voltage path L3*a*. The constant-voltage path L3*a* is provided with a resistor 45*a* and a Zener diode 44*a* therein which are positioned in this order from the point "P". Specifically, a cathode of the Zener diode 44*a* is connected to the resistor 45*a* and an anode is connected to a connecting path L2.

When the on-ignition signal IGt is switched to the off-ignition signal IGt and the inductive voltage of the secondary coil 38*b* is about exceed the breakdown voltage Vz of the Zener diode 44*a* in this configuration, the inductive voltage is restricted to the breakdown voltage Vz and, at the same time, current flows through the constant-voltage path L3*a*. In other words, the voltage applied to the gap is retained to the level of the breakdown voltage Vz.

In a deterioration determination process of the second embodiment, the ECU 46 determines the spark plug 26 to be deteriorated if the determination current If passing through the resistor 45*a* in the off-ignition-signal period has a value other than zero.

Thus, in the second embodiment, the deterioration determination process is conducted using the ignition system shown in FIG. 6 to obtain the effects similar to those of the first embodiment.

Further, the second embodiment includes a circuit configuration in which an end of the constant-voltage path L3*a* is not grounded. Accordingly, for example, this configuration can omit a vehicle-side grounding terminal for the connection of the constant-voltage path, thereby enhancing the degree of freedom in installing the ignition system to a vehicle.

Third Embodiment

Figure 7:
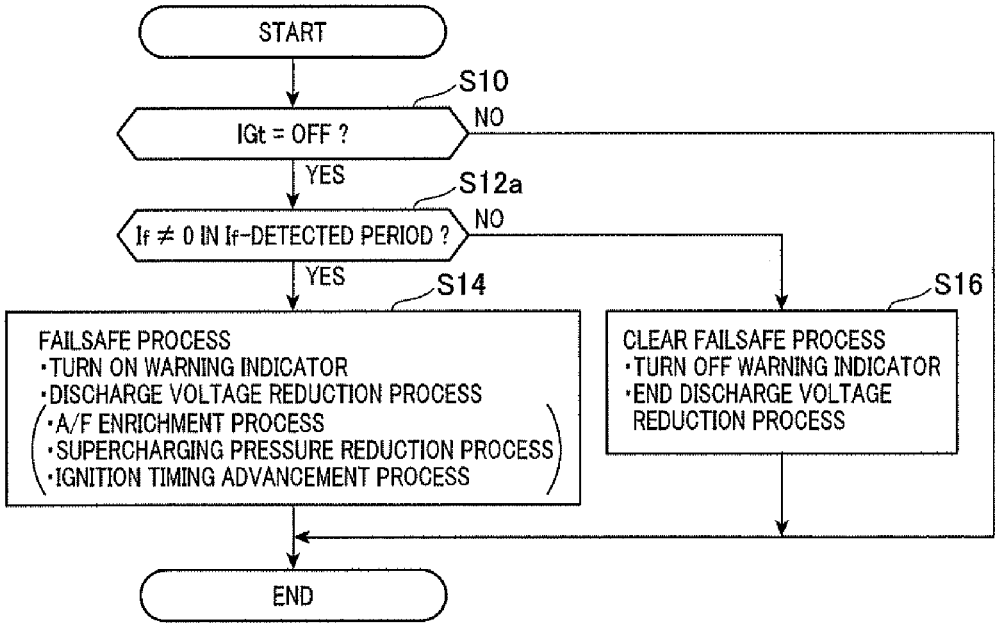
FIG. 7 is a flow diagram illustrating a deterioration determination process conducted of a spark plug, according to a third embodiment of the present invention.

Referring to FIGS. 7 and 8, a third embodiment of the present invention is described focusing on the differences from the first embodiment.

In the third embodiment, the deterioration determination process is different from that of the first embodiment.

FIG. 7 is a flow diagram illustrating a series of steps of a deterioration determination process according to the third embodiment. This process is performed by the ECU 46.

Figures 8A, 8B, 8C:
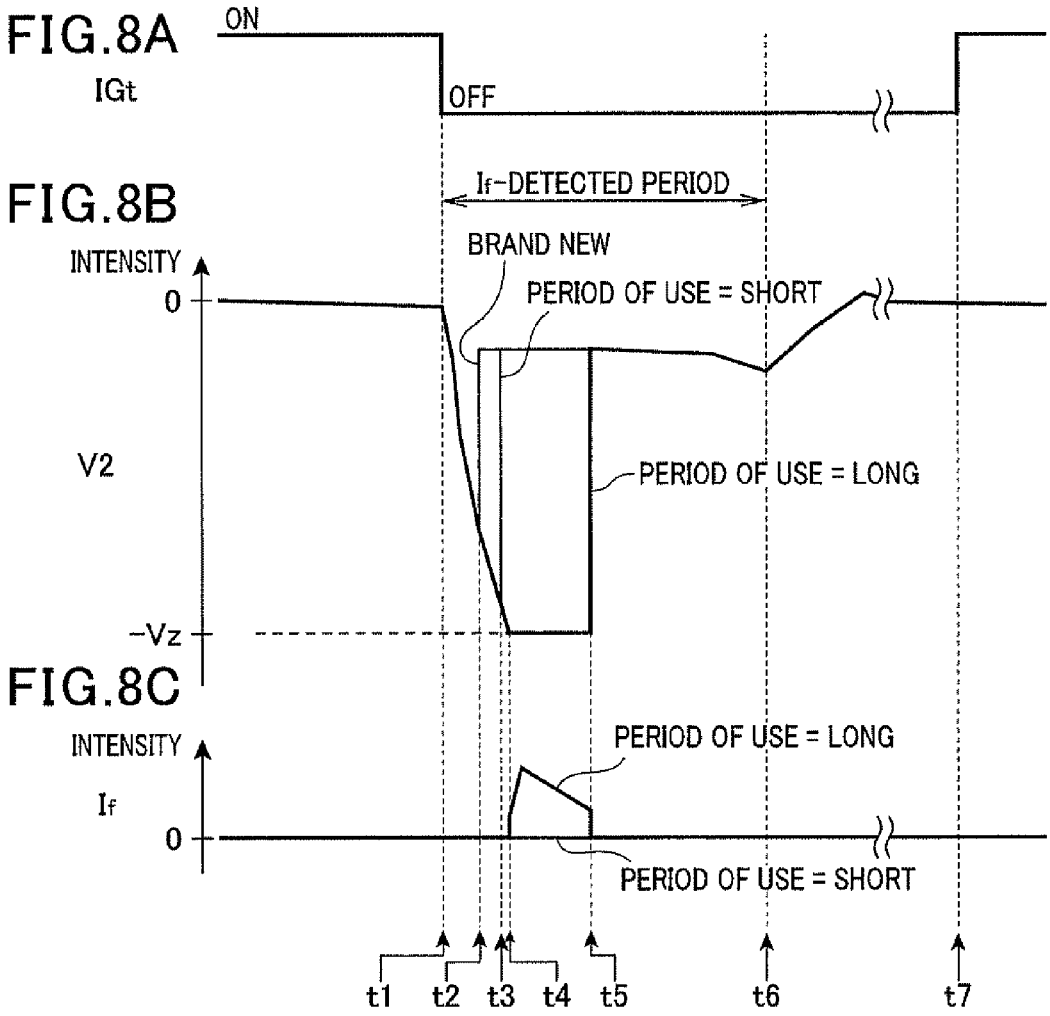
FIGS. 8A to 8C are timing diagrams illustrating signals and voltages involved in the deterioration determination process conducted of the spark plug, according to the third embodiment.

At step S10, if an affirmative determination is made, control proceeds to step S12*a*. At step S12*a*, the ECU 46 determines whether or not the determination current If has a value other than zero in an If-detected period (period in which the determination current If is detected), i.e. whether or not current flows through the constant-voltage path L3. Specifically, as shown in FIGS. 8A to 8C, the ECU 46 determines whether or not the determination current If has a value other than zero in a period from time t1 when the on-ignition signal (IGt) is switched to the off-ignition signal (IGt) until time t6 when the If-detected period expires. It should be appreciated that FIGS. 8A to 8C correspond to FIGS. 5A to 5C, respectively.

The determination as to whether or not the determination current If has a value other than zero in the If-detected period may be made with the combination such as of a well-known latch circuit and a software processing or the like performed by the ECU 46. Specifically, if it is determined that the determination current (If) has a value other than zero in the If-detected period, the information may be stored in the latch circuit. Alternatively, for example, the information stored in the latch circuit accordingly may be reset at the end of the present step in preparation for the subsequent determination.

The If-detected period is disposed based on an idea of enhancing the accuracy of determining deterioration of the spark plug 26 based on the determination current If. Specifically, when the If-detected period is excessively long, there is a high probability that noise caused by some factors is detected as the determination current If. In this case, the ECU 46 may determine that current passes through the constant-voltage path L3, in spite of the fact that no current passes therethrough. This may lead to an erroneous determination that the spark plug 26 is deteriorated.

On the other hand, when the If-detected period is excessively short, there is a high probability of not detecting current passing through the constant-voltage path L3, in spite of the fact that current does pass therethrough. In this case, the ECU 46 may erroneously determine that the spark plug 26 is not deteriorated, in spite of the fact that it is deteriorated. In light of these matters, the If-detected period in the present embodiment is set to a predetermined fixed value that falls within a range from when the on-ignition signal IGt is switched to the off-ignition signal IGt until when ignition is expected to occur (e.g., a few μsec to a few hundred μsec).

If an affirmative determination is made at step S12*a*, it means that the spark plug 26 is determined to be deteriorated and control proceeds to step S14.

If a negative determination is made at step S12*a*, control proceeds to step S16 at which the failsafe process is cleared. Thus, the warning indicator 48 is turned off and the discharge voltage reduction process is ended.

If a negative determination is made at step S10, or when the process at step S14 or S16 is completed, the series of steps of the present process is temporarily terminated.

The effects similar to those of the first embodiment can also be obtained by performing the deterioration determination process described above.

Fourth Embodiment

Figure 9:
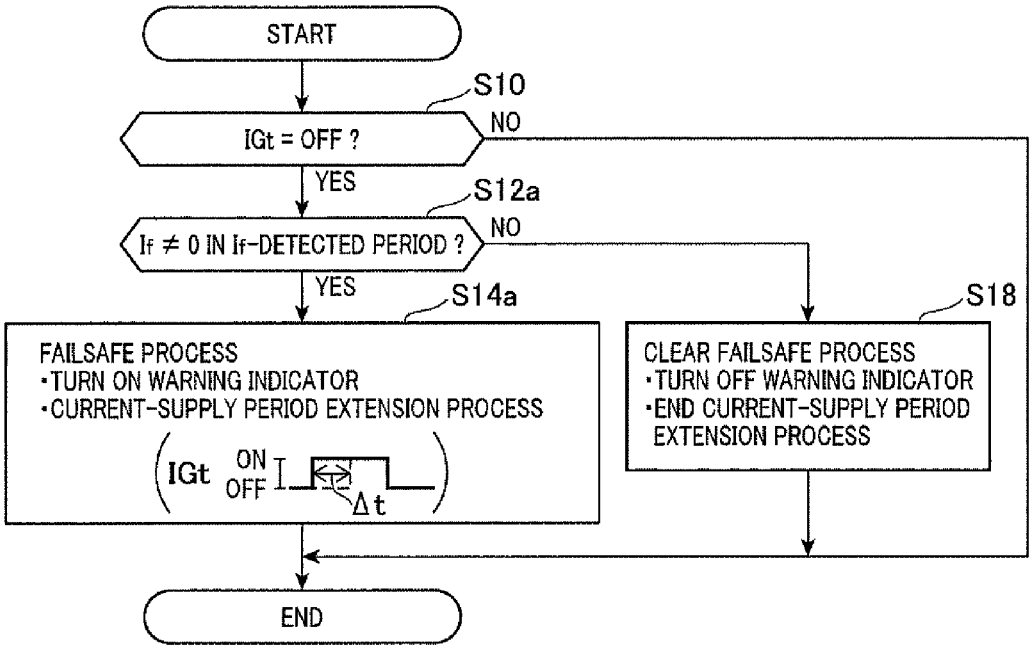
FIG. 9 is a flow diagram illustrating a deterioration determination process that includes a current-supply period extension process, according to a fourth embodiment of the present invention.

Referring to FIG. 9, a fourth embodiment of the present invention is described focusing on the differences from the third embodiment.

The fourth embodiment is different from the third embodiment in that, in the failsafe process, a current-supply period extension process to the primary coil (38*a*) can be performed instead of the discharge voltage reduction process. In the current-supply period extension process, the period of supplying current to the primary coil 38*a* is extended. This process has a purpose of avoiding the occurrence of an accidental fire in the engine 10.

Specifically, when the degree of deterioration of the spark plug 26 becomes higher, current will pass through the constant-voltage path L3 in the off-ignition-signal period. Then, the electro-magnetic energy stored in the spark coil 38 is decreased. As a result, an accidental fire may occur in the engine 10. The current-supply period extension process is performed in order to cope with such a problem.

FIG. 9 is a diagram illustrating a series of a deterioration determination process that includes the current-supply period extension process, according to the fourth embodiment. This deterioration determination process is performed by the ECU 46.

In the series of steps, if an affirmative determination is made at step S12*a*, control proceeds to step S14*a*. At step S14*a*, a failsafe process including the notification process and the current-supply period extension process is performed. In the current-supply period extension process of the present embodiment, a predetermined value Δt is added to the period in which the on-ignition signal IGt is outputted (hereinafter referred to as "on-ignition-signal period") (pulse width of an on-ignition signal). Specifically, in the current-supply period extension process, the predetermined value Δt is added to the on-ignition-signal period in a map that defines the on-ignition-signal period correlated with the operating conditions of the engine 10.

According to the current-supply period extension process, in spite of a state where current passes through the constant-voltage path L3, the electro-magnetic energy stored in the spark coil 38 can be increased on and after the subsequent combustion cycles. This can compensate the electro-magnetic energy decreased due to the flow of current through the constant-voltage path L3.

In the present embodiment, the timing of starting the output of the on-ignition signal IGt is advanced by the predetermined value Δt in the on-ignition-signal period, as defined in the map, thereby extending the current-supply period. Accordingly, the extension of the current-supply period has no influence on the ignition timing that is the timing when the on-ignition signal IGt is switched to the off-ignition signal IGt.

If a negative determination is made at step S12*a*, control proceeds to step S18 at which the failsafe process is cleared. Thus, the warning indicator 48 is turned off and the current-supply period extension process is ended.

If a negative determination is made at step S10 or when the process at step S14*a* or S18 is completed, the series of steps of the present process is temporarily terminated.

Thus, in the fourth embodiment, the execution of the current-supply period extension process can compensate the electro-magnetic energy stored in the spark coil 38 and decreased due to the flow of current through the constant-voltage path L3. Further, an accidental fire is suppressed from occurring in the engine 10 in a favorable manner.

Further, according to the current-supply period extension process, the failsafe process may be completed on an ignition system in the case where the spark plug 26 is deteriorated.

Modifications of First to Fourth Embodiments

The first to fourth embodiments described above may be implemented in the following modifications.

The way of determining the breakdown voltage Vz of the Zener diode 44 is not limited to the one exemplified in the above embodiments. For example, the breakdown voltage Vz may be set to the upper-limit withstand voltage.

Further, for example, the breakdown voltage Vz may be determined without taking into account the maximum discharge voltage expected to be generated when the engine 10 is operated. In this case, a current may be detected by the resistor 45 before the degree of deterioration of the spark plug 26 becomes high. This configuration may use the following deterioration determination process. In this deterioration determination process, the spark plug 26 is determined to be deteriorated if a period in which current is detected by the resistor 45 (hereinafter referred to as "current-detected period") (e.g., the period between t4 and t5 of FIGS. 5A to 5C) in the off-ignition-signal period is determined to exceed a threshold period (corresponding to the standard period) which is longer than zero. More specifically, the current-detected period may be stored in a storing means (nonvolatile memory) included the ECU 46. If the latest period stored in the storing means is determined to exceed the threshold period, the spark plug 26 may be determined as being deteriorated. The threshold period is defined to be a period which can determine the occurrence of deterioration in the spark plug 26. For example, the threshold period is determined by testing in advance.

In a case one provides the above deterioration determination process in present apparatus, it is desirable that ECU stores the current-detected period, being correlated to parameters (e.g., the operating conditions or in-cylinder pressure of the engine 10) that give influences to the current-detected period in the off-ignition-signal period, furthermore sets the threshold period, being correlated to the parameters. According to this embodiment, since the current-detected period depends on the parameters, the accuracy of determining deterioration as being caused in the spark plug 26 is enhanced.

The position of the resistor for detecting current is not limited to the ones exemplified in the above embodiments. For example, instead of the configuration shown in FIG. 2, the resister 45 may be poisoned between the Zener diode 44 and the connecting path L2. Also, for example, instead of the configuration shown in FIG. 6, the resister 45 may be poisoned between the Zener diode 44*a* and the connecting path L2.

The circuit configuration of the ignition system is not limited to the ones exemplified in the above embodiments. For example, in FIG. 2, the ignition system may have a circuit configuration such that one of two ends of the low-voltage side path L1, the end being opposite to the secondary coil 38*b*, is grounded.

The circuit configuration of the ignition system in each of the embodiments described above is based on what is called "negative discharge" in which discharge current flows from the ground electrode to the center electrode of the spark plug when the on-ignition signal IGt is switched to the off-ignition signal IGt, with the center electrode serving as a negative pole and the ground electrode serving as a positive pole. However, the circuit configuration is not limited to this. For example, the circuit configuration may be based on what is called "positive discharge" in which discharge current flows from the center electrode to the ground electrode when the on-ignition signal IGt is switched to the off-ignition signal IGt, with the center electrode serving as a positive pole and the ground electrode serving as a negative pole.

The frequency of performing the deterioration determination process is not limited to the one exemplified in the first embodiment. For example, the deterioration determination process may be executed every time the ignition control is executed.

The way of notifying the user of the occurrence of deterioration in the spark plug 26 is not limited to the one exemplified in the first embodiment. For example, a sound may be used to notify the user of the occurrence of deterioration.

At step S14*a* of FIG. 9 in the fourth embodiment, the discharge voltage reduction process may be added to the failsafe process.

The way of increasing the electric energy supplied to the primary coil 38*a* is not limited to the one exemplified in the fourth embodiment. For example, in increasing the electric energy, the voltage applied to the primary coil 38*a* may be increased without extending the on-ignition-signal period. For example, this may be realized by connecting a step-up converter to the battery 40 and applying the output voltage of the step-up converter to the primary coil 38*a*. In this case as well, the electro-magnetic energy stored in the spark coil 38 is increased. Alternatively, in increasing the electric energy, the on-ignition-signal period may be extended while the voltage applied to the primary coil 38*a* is increased.

Alternatively, in increasing the electric energy supplied to the primary coil 38*a*, the on-ignition-signal period may be extended by the predetermined value Δt, followed by gradually reducing the on-ignition-signal period. For example, this may be realized by extending the on-ignition-signal period by the predetermined value Δt, followed by reducing the on-ignition-signal period by a specified value in each control cycle of the ECU 46, on condition that the on-ignition-signal period does not fall below a lower-limit guard value (e.g., initial value of the on-ignition-signal period defined in the map). The specified value here is set to a value sufficiently smaller that the predetermined value Δt. For example, reduction of the on-ignition-signal period may be continued on condition that no accidental fire occurs in the engine 10.

In addition, alternatively, in increasing the electric energy supplied to the primary coil 38*a*, the on-ignition-signal period may be gradually extended on the basis of the specified value. In this case, it is desirable that an upper-limit guard value is set to a value equivalent to the on-ignition-signal period.

In the current-supply period extension process of the fourth embodiment, the timing of starting the output of the on-ignition signal is advanced in the on-ignition-signal period defined in the map to extend the current-supply period. However, the current-supply period extension process is not limited to this. For example, the current-supply period extension process may be performed such that the timing of ending the output of the on-ignition signal is retarded by the predetermined value Δt. Alternatively, in the current-supply period extension process, advancing the timing of starting the output of the on-ignition signal may be combined with retarding the timing of ending the output of the on-ignition signal. In these cases as well, the electro-magnetic energy of the spark coil 38 can be compensated.

In the third embodiment, the If-detected period may be variably determined according to the operating conditions of the engine 10, on condition that the If-detected period falls within a period ranging from when the on-ignition signal is switched to the off-ignition signal until when ignition is expected (e.g., a few μsec to tens of μsec).

In the third embodiment, the information regarding the determination current If stored in the latch circuit may be reset at the timing of the subsequent output of the on-ignition signal IGt (time t7 in FIGS. 8A to 8C).

In the third and fourth embodiments, the failsafe process is not necessarily required to be cleared (step S16 of FIG. 7 and step S18 of FIG. 9) but, instead, a control logic may be used to retain the action of the failsafe process. In this case, for example, the extension of the on-ignition-signal period in the fourth embodiment is not stopped, which would otherwise have been stopped by the clearance of the failsafe process. Therefore, for example, the extension of the on-ignition-signal period is continued, for example, until the spark plug 26 is replaced by a car dealer for the clearance of the current-supply period extension process.

In the fourth embodiment, the warning indicator 48 is not necessarily required to be turned off in clearing the failsafe process. Thus, since the warning indicator 48 is continuously lit, the user is prompted to replace the spark plug 26.

The current detecting means is not limited to the resistor. For example, the current detecting means may be a current sensor that uses a Hall element.

The constant-voltage element is not limited to the one in each of the above embodiments. For example, the constant-voltage element may be an Avalanche diode that causes Avalanche breakdown when the voltage across the terminals of the element becomes equal to a specified voltage. Alternatively, an element other than a Zener diode or an Avalanche diode may be used as the constant-voltage element if only the element has functions similar to those of the Zener or Avalanche diode.

The first to fourth embodiments have been described so far, each of which uses a control apparatus having a function of determining deterioration as being caused in a spark plug. Fifth to eighth embodiments set forth below deal with a control apparatus having a function of determining the occurrence of an open failure in a constant-voltage path.

Fifth Embodiment

Figure 10:
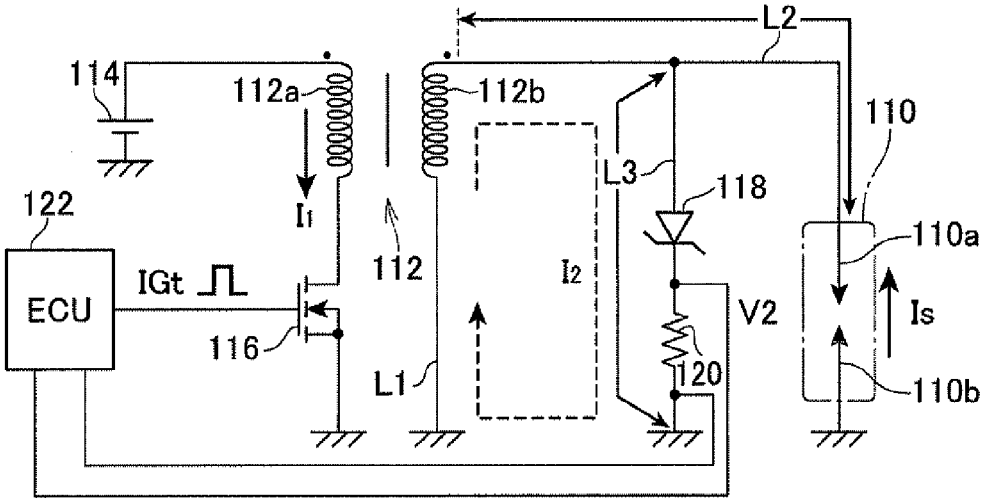
FIG. 10 is a schematic diagram illustrating an ignition system, according to a fifth embodiment of the present invention.
Figure 11:
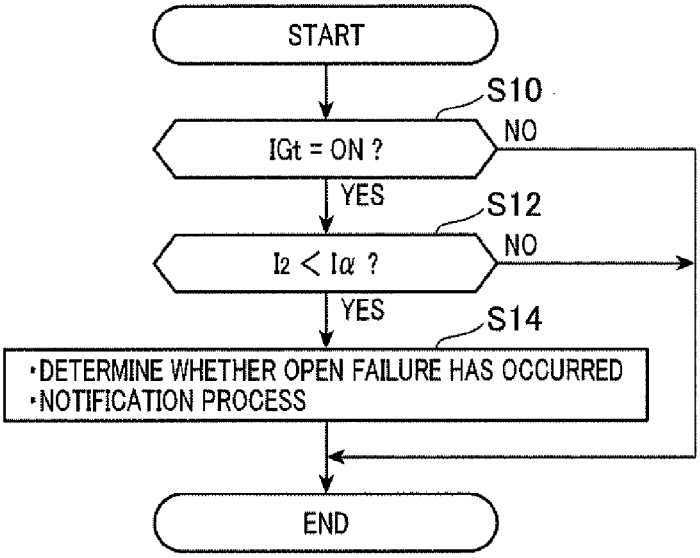
FIG. 11 is a flow diagram illustrating a failure determination process, according to the fifth embodiment.
Figures 12A, 12B, 12C, 12D, 12E, 12F, 12G:
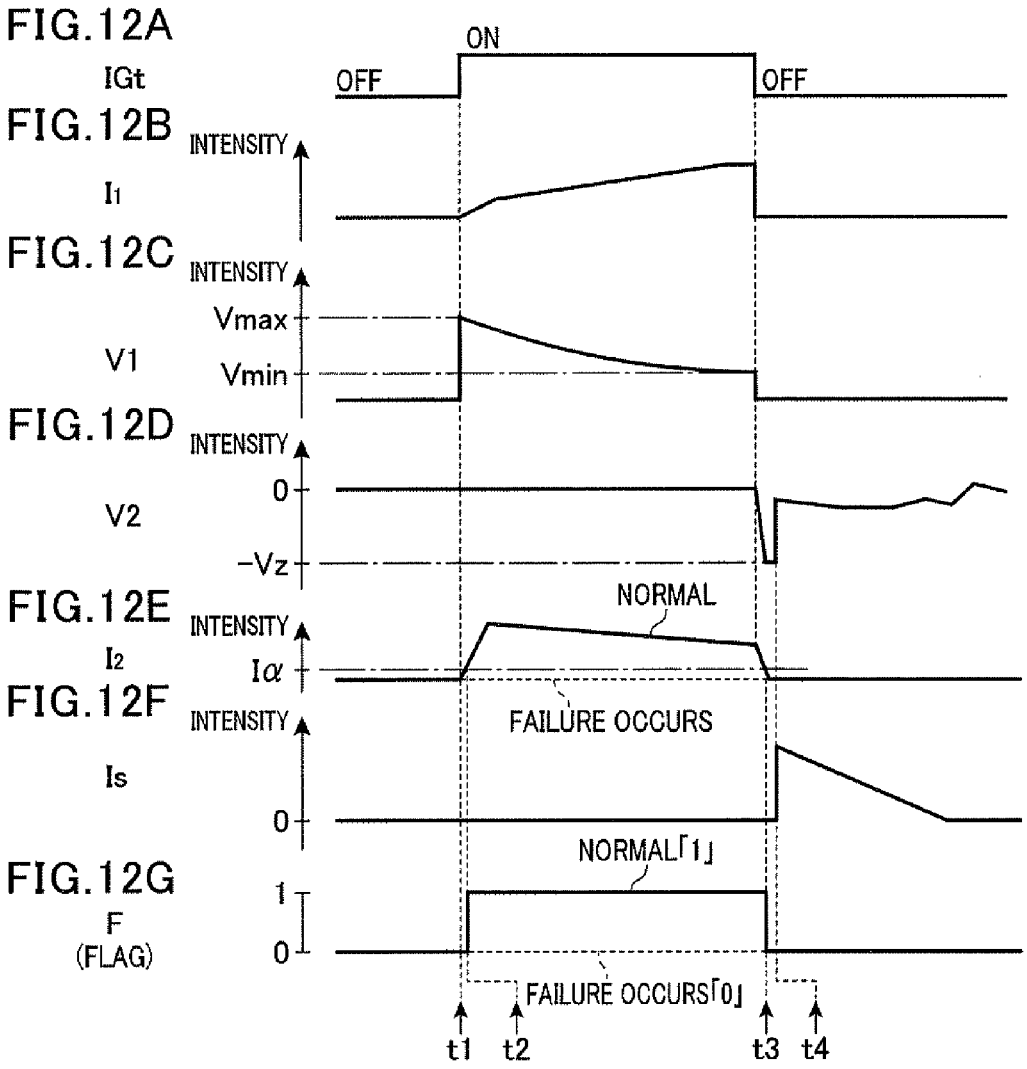
FIGS. 12A to 12G are timing diagrams illustrating signals and voltages involved in the failure determination process, according to the fifth embodiment.

Referring to FIGS. 10 and 11 and FIG. 12A, hereinafter is described a fifth embodiment of the present invention.

FIG. 10 is a schematic diagram generally illustrating an ignition system according to the fifth embodiment. As shown in FIG. 10, the ignition system includes a spark plug 110 and a spark coil 112. The spark plug 110 is composed of a center electrode 110*a* and a ground electrode 110*b* to exert a function of producing discharge sparks in the combustion chamber of an engine (not shown).

The spark coil 112 is composed of a primary coil 112*a* and a secondary coil 112*b* being electro-magnetically connected to the primary coil 112*a*. The primary coil 112*a* has two ends, one of which is connected to a positive electrode of a battery 114. Another end of the primary coil 112*a* is grounded via an input/output terminal of a switching element 116 (N-channel MOSFET) that is an electronically operated opening/closing means having an opening/closing control terminal (gate). A negative terminal of the battery 114 is grounded. In the present embodiment, the battery 114 is a lead battery having a terminal voltage Vb of 12 V. Also, in the present embodiment, a grounding electrical potential is corresponding to 0 (zero) V.

The secondary coil 112*b* has two ends, one of which is grounded via the low-voltage side path L1. Another end is connected to the center electrode 110*a* via the connecting path L2.

The connecting path L2 is connected to the constant-voltage path L3. One end of the constant-voltage path L3 is grounded. The constant-voltage path L3 is provided with a Zener diode 118 and a resistor 120 therein which are positioned in this order from a connecting path L2 to a grounding portion. The Zener diode 118 is used as a constant-voltage element. An anode of the Zener diode 118 is connected to the connecting path L2, and a cathode is connected to the resistor 120.

An electronic control unit (hereinafter referred to as "ECU 122") is mainly configured by a microcomputer to control the ignition system (perform an ignition control). The ECU 122 detects a current passing through the resistor 120 on the basis of the amount of voltage drop in the resistor 120. Also, the ECU 122 outputs an ignition signal IGt to the opening/closing terminal (gate) of the switching element 116 so that discharge sparks are produced in the spark plug 110.

In the ignition control, the ECU 122 outputs an ignition signal IGt, first, to the gate of the switching element 116 to bring the switching element 116 into an on-state (this ignition signal is hereinafter referred to as "on-ignition signal IGt"). With the output of the on-ignition signal IGt, current (primary current $I_1$) is started to be supplied from the battery 114 to the primary coil 112*a* to thereby start storage of electro-magnetic energy in the spark coil 112. In the present embodiment, when current is supplied to the primary coil 112*a*, polarity is positive at one of two ends of the secondary coil 112*b*, which is connected to a center electrode 110*a*, and polarity is negative at another end being grounded.

After starting current supply to the primary coil 112*a*, the on-ignition signal IGt is switched to an ignition signal IGt that brings the switching element 116 into an off-state (this signal is hereinafter referred to as "off-ignition signal IGt"). Then, the polarities at both ends of the secondary coil 112*b* are mutually reversed and, at the same time, a high voltage is induced in the secondary coil 112*b*. Thus, a high voltage is applied to the gap between the center electrode 110*a* and the ground electrode 110*b* of the spark plug 110.

In the fifth embodiment, the constant-voltage path L3 includes the Zener diode 118 as mentioned above. Therefore, when the voltage (secondary voltage V2) applied to the gap of the spark plug 110 is about to exceed a breakdown voltage Vz of the Zener diode 118, a voltage drop corresponds to the level of the breakdown voltage Vz occurs in the Zener diode 118 and thus the secondary voltage V2 is restricted to the breakdown voltage Vz. In other words, the secondary voltage V2 is retained to the level of the breakdown voltage Vz in a period in which the secondary voltage V2 is about to exceed the breakdown voltage Vz.

The conditions of the gas in the gap will become suitable for discharge in the period in which the secondary voltage V2 is retained to the level of the breakdown voltage Vz. When the suitable conditions of the gas are met, discharge sparks are produced in the gap of the spark plug 110, while a current (discharge current Is) is permitted to flow from the ground electrode 110*b* to the center electrode 110*a*. With this configuration, discharge voltage of the spark plug 110 is prevented from being increased.

In the fifth embodiment, the breakdown voltage Vz of the Zener diode 118 is determined so as to be higher than the discharge voltage of a brand-new spark plug 110 and lower than an allowable upper limit (upper-limit withstand voltage) of the discharge voltage of the spark plug 110. This manner of determining the breakdown voltage Vz is based on an idea of preventing the discharge voltage of the spark plug 110 from becoming excessively high due to the aged deterioration of the spark plug 110. In other words, although the discharge voltage of the spark plug 110 at the initial use is low, the discharge voltage will increase as the period of use of the spark plug 110 becomes longer to increase the degree of deterioration of the spark plug 110 accordingly. The upper-limit withstand voltage mentioned above refers, for example, to an upper limit of the discharge voltage, which can maintain the reliability of the ignition system.

A failure determination process according to the fifth embodiment is described.

In the failure determination process, it is determined whether or not an open failure has occurred in the constant-voltage path L3 in the period in which current is supplied to the primary coil 112*a*, under the conditions where the on-ignition signal IGt is outputted. The failure determination process is performed for the purpose of not impairing the reliability of the ignition system. The open failure of the constant-voltage path L3 includes, for example, disconnection of the constant-voltage path L3 or an open failure of the Zener diode 118.

In the fifth embodiment, the failure determination process is performed in the period in which current is supplied to the primary coil 112*a*, for the reasons provided below.

Under the conditions where the off-ignition signal IGt is outputted, current passes through the constant-voltage path L3 when the secondary voltage V2 is about to exceed the breakdown voltage Vz of the Zener diode 118. For this reason, for example, in the failure determination process, the occurrence of an open failure in the constant-voltage path L3 may be determined when no current is determined to be detected by the resistor 120 under the conditions where the off-ignition signal IGt is outputted. However, this may raise a problem that the occurrence of the open failure cannot be determined until the degree of deterioration of the spark plug 110 becomes high and the secondary voltage V2 comes to be restricted to the breakdown voltage Vz. In addition, it may be difficult to know the state where the secondary voltage V2 is restricted to the breakdown voltage Vz. This is because, as shown in FIG. 12F, the discharge voltage of the spark plug 110 greatly depends on the operating conditions of the engine, as well as the degree of deterioration of the spark plug 110. If the state of the restriction is not correctly known by the driver, there may be a problem that the occurrence of the open failure is erroneously determined.

In this regard, when the open failure determination process is performed in the period in which current is supplied to the primary coil 112*a*, the problems mentioned above will not be raised. Therefore, in the present embodiment, the failure determination process is performed in the period in which current is supplied to the primary coil 112*a*.

FIG. 11 shows a series of steps of the failure determination process of the fifth embodiment. This process is performed by the ECU 122.

First, at step S110, the ECU 122 determines whether or not the outputted signal IGt is corresponds to an on-ignition signal. This step is performed for the purpose of detecting whether or not current is passed through the primary coil 112*a*.

If an affirmative determination is made at step S110, control proceeds to step S112. At step S112, the ECU 122 determines whether or not a secondary current $I_2$ detected by the resistor 120 is less than a threshold current Iα (>0). This step is performed for the purpose of determining whether or not the secondary current $I_2$ flows through the constant-voltage path L3. The secondary current $I_2$ here refers to a current that flows through the constant-voltage path L3 in a direction from the secondary coil 112*b* toward the Zener diode 118 when current is passed through the primary coil 112*a*.

If an affirmative determination is made at step S112, the ECU 122 determines that no secondary current $I_2$ is detected and control proceeds to step S114. At step S114, the ECU 122 determines that an open failure has occurred in the constant-voltage path L3. Then, the ECU 122 carries out a notification process to notify the user of the occurrence of an open failure. For example, the notification process may specifically be performed by lighting a warning indicator or emitting a sound.

If a negative determination is made at step S110 or S112, or when step S114 is completed, the series of steps is temporarily terminated.

FIGS. 12A to 12G show an example of the failure determination process of the fifth embodiment. FIG. 12A shows transition of the ignition signal IGt. FIG. 12B shows transition of the primary current $I_1$. FIG. 12C shows transition of inductive voltage V1 of the secondary coil 112*b*. FIG. 12D shows transition of the secondary voltage V2. FIG. 12E shows transition of the secondary current $I_2$. FIG. 12F shows transition of the discharge current Is. FIG. 12G shows transition of the value of a failure determination flag F. Under the conditions where the on-ignition signal IGt is outputted, the failure determination flag F is set to "1" to indicate that no open failure has occurred and "0 (zero)" indicate that an open failure has occurred. In FIGS. 12A to 12G, the primary current $I_1$ that flows from the battery 114 toward the switching element 116 is defined to be positive. Also, the secondary current $I_2$ that flows through the Zener diode 118 from the anode side to the cathode side is defined to be positive. Further, the discharge current Is that flows from the ground electrode 110*b* to the center electrode 110*a* is defined to be positive.

As indicated by a solid line in FIG. 12B, when the off-ignition signal IGt is switched to the on-ignition signal (see FIG. 12A), current supply of the primary current $I_1$ is started at time t1 (see FIG. 12B). Then inductive voltage generates in the secondary coil 112*b* (see FIG. 12C). As a result, the secondary current $I_2$ flows through the constant-voltage path L3 in a direction from the secondary coil 112*b* toward the Zener diode 118 (see FIG. 12E).

After that, at time t2 when the secondary current $I_2$ is judged to become equal to or higher than the threshold current Iα, if the ECU 122 judges that the secondary current $I_2$ has been detected, then the value of the failure determination flag F is set to "1" (see FIG. 12G). This indicates that open failure has not occurred.

After that, at time t3 when the secondary current $I_2$ is judged to be smaller than the threshold current Iα, the value of the flag F is set to "0" (see FIG. 12G). Even though the Flag is set to "0" in this occasion, the persons skilled in the art will be able to understand that this does not mean the open failure has occurred.

This is followed by a period in which the voltage applied to the gap of the spark plug 110 is retained at the level of the breakdown voltage Vz of the Zener diode 118. At time t4 in the period, discharge sparks are produced in the gap, while the discharge current Is flows from the ground electrode 110*b* to the center electrode 110*a*. In FIG. 12E, indication of the current flowing through the Zener diode 118 is omitted from the period in which the secondary voltage V2 is retained to the level of the breakdown voltage Vz.

On the other hand, if an open failure occurs in the constant-voltage path L3, no secondary current $I_2$ is detected, as indicated by a broken line in FIG. 12E, between times t1 and t3 that is a period in which the on-ignition signal IGt is outputted (hereinafter referred to as "on-ignition-signal period"). Therefore, the ECU 122 determines that an open failure has occurred in the constant-voltage path L3 and sets up the failure determination flag F with an indication of the value "0".

As described above, in the fifth embodiment, the ECU 122 determines the occurrence of an open failure in the constant-voltage path L3 if no secondary current $I_2$ is determined to be detected in the on-ignition signal period. Then, if it is determined that an open failure has occurred, a notification process is performed to notify the user accordingly. Thus, for example, the open failure in the constant-voltage path L3 is fixed as promptly as possible, avoiding impairing the reliability of the ignition system in a favorable manner.

Sixth Embodiment

Figure 15:
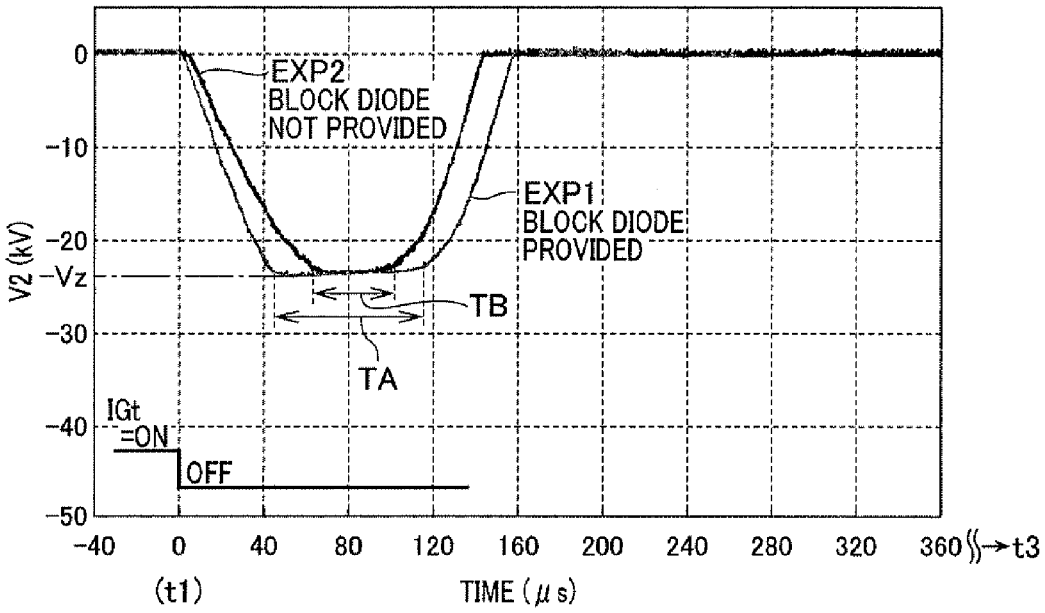
FIG. 15 is a diagram illustrating effects exerted by a block diode, according to the sixth embodiment.

Referring now to FIGS. 13 to 15, hereinafter is described a sixth embodiment of the present invention focusing on the differences from the fifth embodiment described above.

FIG. 13 is a schematic diagram generally illustrating an ignition system according to the sixth embodiment. The illustration of the ECU 122 is omitted in.

As shown in FIG. 13, a diode (block diode 124) is disposed between a secondary coil 112*b* and the point "P" at which the connecting path L2 and the constant-voltage path L3 is connected. The block diode 124 is used as a restricting element. Specifically, the anode of the block diode 124 is connected to the anode of the Zener diode 118 via connecting point "P" while the cathode of the block diode 124 is connected to one end of the secondary coil 112*b*.

Hereinafter is described a role of the block diode 124 that has a configuration characteristic of the sixth embodiment.

The block diode 124 serves as a member that suppresses decrease of the inductive voltage generated in the secondary coil 112*b*. Thus, discharge sparks are produced in the gap, or the period in which the voltage applied between the gap is retained to the level of the breakdown voltage Vz (hereinafter referred to as a constant-voltage duration) is hardly shortened under the conditions where the applied voltage is about to exceed the breakdown voltage Vz. In the sixth embodiment, a breakdown voltage Vlimit of the block diode 124 is set to a voltage which is smaller than a maximum value Vmax of the voltage applied across the anode and the cathode of the block diode 124 when current is supplied to the primary coil 112*a* (e.g., 2 kV), but larger than a minimum value Vmin of the voltage applied across the anode and the cathode at the timing when the current supply to the primary coil 112*a* is cut off (e.g., 1 kV). For example, the maximum value Vmax specifically corresponds to a value obtained by multiplying N2/N1 with the terminal voltage Vb of the battery 114. In this case, N2/N1 is a ratio of a number of turns N1 of the primary coil 112*a* to a number of turns N2 of the secondary coil 112*b*. Thus, flow of the secondary current Is is blocked in the period in which the voltage applied across the cathode and the anode of the block diode 124 is less than the breakdown voltage Vlimit under the conditions where current is passed through the primary coil 112*a*. Referring to FIGS. 14A to 14F, details of the role of the block diode 124 are described.

FIGS. 14A to 14F shows an example of a failure detection process according to the present invention. FIGS. 14A to 14F corresponds to FIGS. 12A to 14F, respectively.

First, a case where a circuit configuration does not include the block diode 124 is explained.

As indicated by a broken line in FIG. 14B, supply of the primary current $I_1$ is started at time t1 when the off-ignition signal IGt is switched to the on-ignition signal. However, under the conditions where current is passed through the primary coil 112*a*, the secondary current $I_2$ is permitted to pass through the constant-voltage path L3 from the secondary coil 112*b* toward the Zener diode 118. This allows decrease of the primary current $I_1$ to thereby decrease the electro-magnetic energy stored in the ignition coil 112. Accordingly, the inductive voltage generated in the secondary coil 112*b* decreases at time t3 when the on-ignition signal IGt is switched to the off-ignition signal IGt (i.e. the ignition signal IGt is switched off). Further, the constant-voltage duration of the spark plug 110 is shortened.

Secondly, a circuit configuration including the block diode 124 is explained.

As indicated by a solid line in FIG. 14C, the inductive voltage V1 of the secondary coil 112*b* gradually decreases under the conditions where the on-ignition signal is outputted. The secondary current $I_2$ flows through the constant-voltage path L3 in a period from time t1 to time t2 in which the inductive voltage V1 of the secondary coil 112*b* exceeds the breakdown voltage Vlimit of the block diode 124. However, the flow of the secondary current $I_2$ through the constant-voltage path L3 is blocked in a period from time t2 to time t3 in which the inductive voltage V1 of the secondary coil 112*b* falls below the breakdown voltage Vlimit. Accordingly, the electro-magnetic energy stored in the spark coil 112 is suppressed from being decreased to thereby suppress the constant-voltage duration of the spark plug 110 from being shortened.

FIG. 15 is a diagram showing measurements of waveform of the secondary voltage V2 in a period from when the on-ignition signal IGt is switched to the off-ignition signal IGt until when discharge sparks are produced. Specifically, in FIG. 15, EXP1 indicates measurements of waveform in the case where the circuit configuration includes the block diode 124. Also, EXP2 indicates measurements of waveform in the case where the circuit configuration does not include the block diode 124.

As shown in FIG. 15, a constant-voltage duration TA of the spark plug 110 when the block diode 124 is included is long compared to a constant-voltage duration TB when the block diode 124 is not included. Specifically, decrease of the electro-magnetic energy stored in the spark coil 112 is suppressed by the block diode 124.

As described above, in the sixth embodiment, the constant-voltage path L3 is provided with the block diode 124 as described above. Accordingly, decrease of the electro-magnetic energy stored in the spark coil 112 is suppressed when the failure determination process is performed. Thus, the inductive voltage generated in the secondary coil 112*b* is suppressed from decreasing when the ignition signal IGt is switched off. As a result, the constant-voltage duration of the spark plug 110 is favorably suppressed from being shortened. In this way, the occurrence of an accidental fire in the engine is favorably prevented.

Seventh Embodiment

Figure 16:
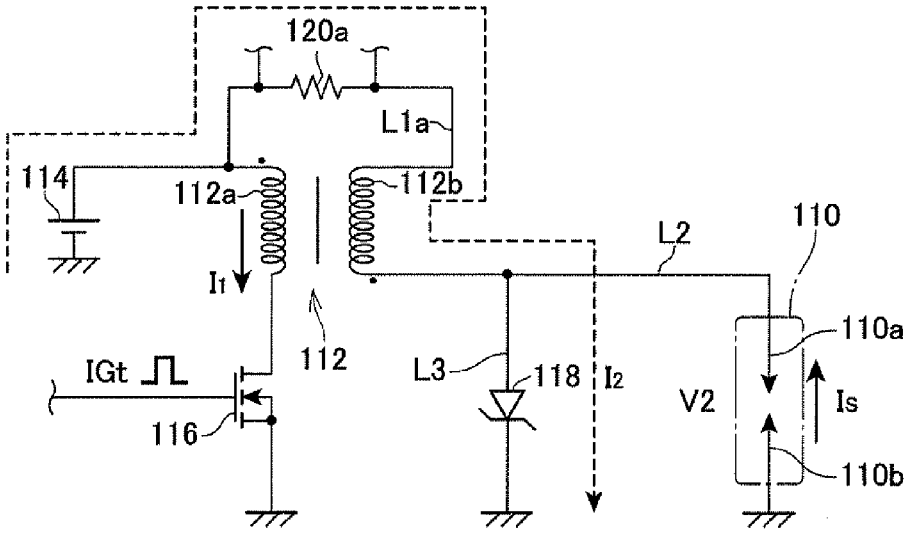
FIG. 16 is a schematic diagram illustrating an ignition system, according to a seventh embodiment of the present invention.

Referring to FIG. 16, a seventh embodiment of the present invention is described focusing on the differences from the fifth embodiment.

FIG. 16 is a schematic diagram generally illustrating an ignition system according to the seventh embodiment. In FIG. 16, illustration of the ECU 122 is omitted.

As shown in FIG. 16, one of two ends of the secondary coil 112*b* is connected to a positive terminal of the battery 114 (corresponding to the member having a standard electric potential) via a low-voltage side path L1*a*. The low-voltage side path L1*a* is provided with a resistor 120*a* therein for detecting current.

A failure determination process is performed in this configuration. In the failure determination process, the ECU 122 determines that an open failure has occurred in the constant-voltage path L3 if no secondary current $I_2$ is determined to be detected by the resistor 120*a* under the conditions where current is passed through the primary coil 112*a*.

In the present embodiment, when current is passed through the primary coil 112*a*, polarity is positive at one of two ends of the secondary coil 112*b*, which is connected to a center electrode 110*a*, and polarity is negative at another end, which is connected to a low-voltage side path L1*a*.

Thus, use of the ignition system of the seventh embodiment as shown in FIG. 16 in performing the failure determination process can also achieve the effects similar to those achieved in the fifth embodiment.

Eighth Embodiment

Figure 17:
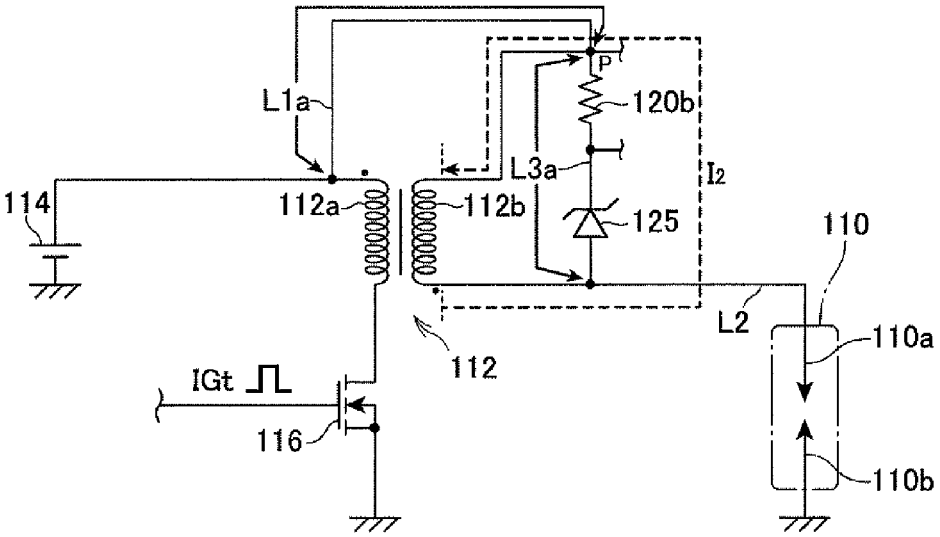
FIG. 17 is a schematic diagram illustrating an ignition system, according to an eighth embodiment of the present invention.

Referring to FIG. 17, an eighth embodiment of the present invention is described focusing on the differences from the seventh embodiment.

FIG. 17 is a diagram generally illustrating an ignition system according to the eighth embodiment.

As shown in FIG. 17, in the eighth embodiment, one of two ends of the low-voltage side path L1*a*, which is shown as a point "P" being connected to a secondary coil 112*b*, is connected to the connecting path L2 via a constant-voltage path L3*a*. The constant-voltage path L3*a* is provided with a resistor 120*b* and a Zener diode 125 therein which are positioned in this order from the point "P". Specifically, the cathode of the Zener diode 125 is connected to the resistor 120*b* and the anode thereof is connected to a connecting path L2.

In this configuration, when the on-ignition signal IGt is outputted in order for ECU to pass current through the primary coil 112*a*, electro-magnetic energy is stored in the spark coil 112. At the same time, the secondary current $I_2$ passes through a closed loop circuit that includes the secondary coil 112*b* and the constant-voltage path L3*a*. In this case, as shown in FIG. 17 in a dotted line, the secondary current $I_2$ is passes through from one of two ends of the secondary coil 112*b*, whose polarity becomes positive, toward the constant-voltage path L3*a*.

After that, when the on-ignition signal IGt is switched to the off-ignition signal IGt and the inductive voltage of the secondary coil 112*b* is about to exceed the breakdown voltage Vz of the Zener diode 125, the inductive voltage is restricted to the breakdown voltage Vz. In other words, the voltage applied to the gap is maintained to the level of the breakdown voltage Vz.

A failure determination process according to the eighth embodiment is described.

An open failure is determined as having occurred in the constant-voltage path L3*a* when the secondary current $I_2$ is determined as not being detected by the resistor 120*b* under the conditions where current is passed through the primary coil 112*a*.

Thus, use of the ignition system of the eighth embodiment as shown in FIG. 17 in performing the failure determination process can also achieve the effects similar to those achieved in the seventh embodiment.

The eighth embodiment uses a circuit configuration in which an end of the constant-voltage path L3*a* is not grounded. For example, this circuit configuration can omit a vehicle-side grounding terminal to which the constant-voltage path is connected, thereby enhancing the degree of freedom in installing the ignition system to the vehicle.

Modifications of the Fifth to Eighth Embodiments

The fifth to the eighth embodiments may be implemented in the modifications as set forth below.

Figure 18:
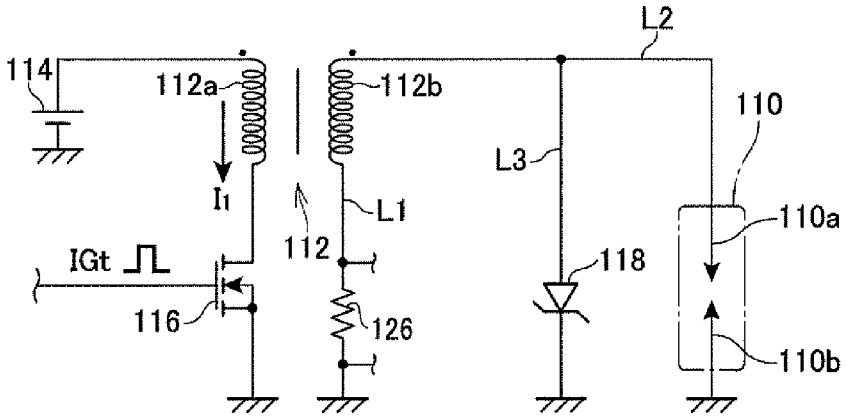
FIG. 18 is a schematic diagram illustrating an ignition system, according to a modification 1.

In the circuit configuration of the fifth embodiment, the resistor for detecting current may be arranged as follows. For example, as shown in FIG. 18, a resistor 126 may be arranged in the low-voltage side path L1.

In the circuit configuration of the sixth embodiment, the block diode may be arranged as follows.

Figure 19A:
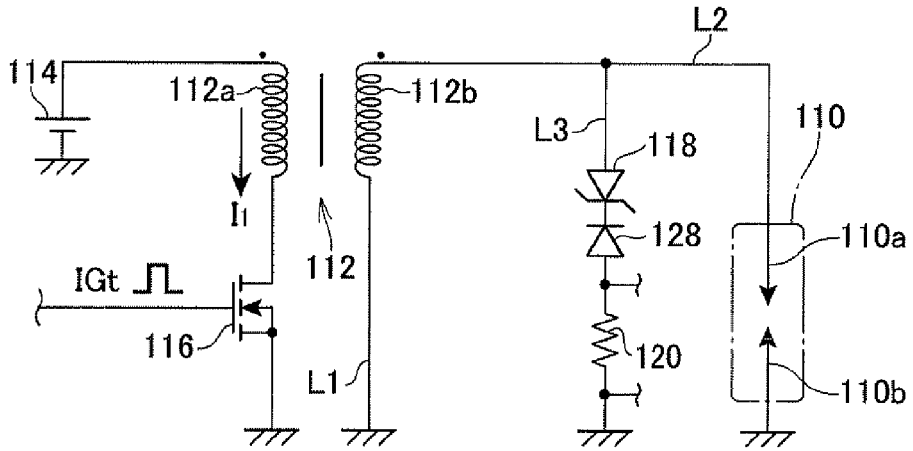
FIGS. 19A and 19B are diagrams illustrating ignition systems, according to a modification 2.
Figure 19B:
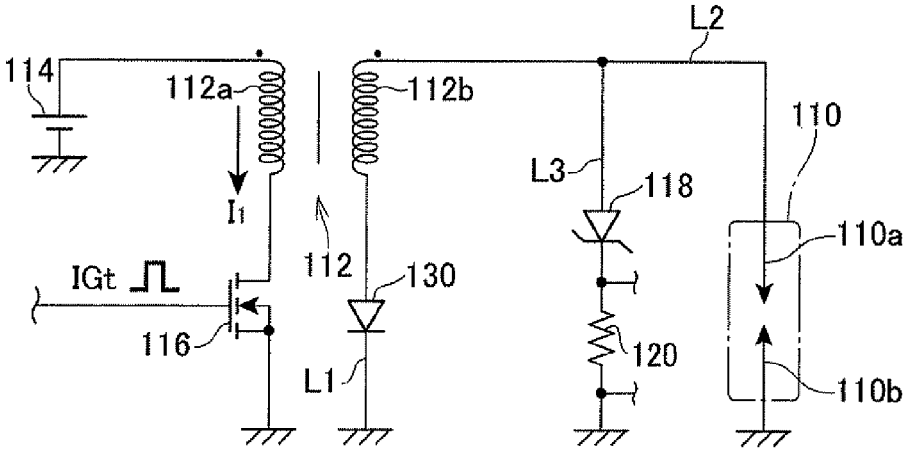

For example, as shown in FIG. 19A, a block diode 128 may be arranged in the constant-voltage path L3 so as to be located between the Zener diode 118 and the resistor 120. In this case, the open failure of the constant-voltage path L3 includes an open failure of the block diode 128. Further, as shown in FIG. 19B, for example, a block diode 130 may be arranged in the low-voltage side path L1.

Figure 20A:
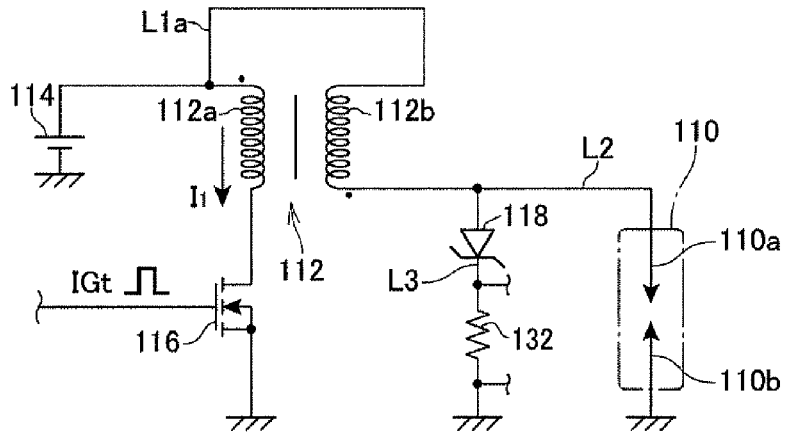
FIGS. 20A to 20C are diagrams illustrating ignition systems, according to a modification 3.

In the circuit configuration of the seventh embodiment, the resistor for detecting current may be arranged as follows. For example, as shown in FIG. 20A, a resistor 132 may be arranged in the constant-voltage path L3.

Figure 20B:
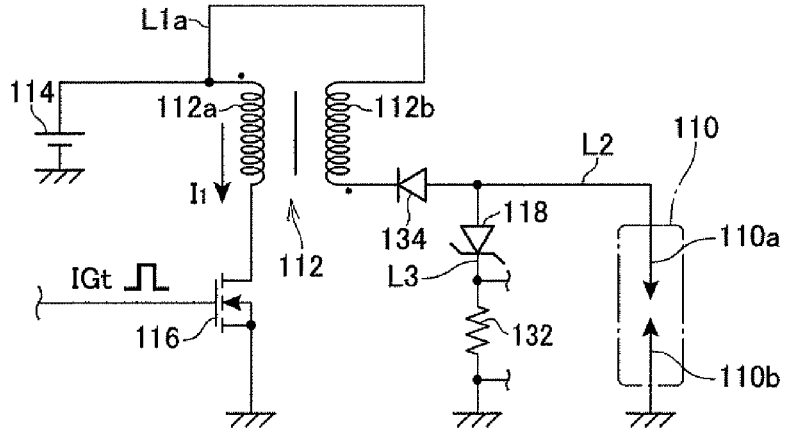
Figure 20C:
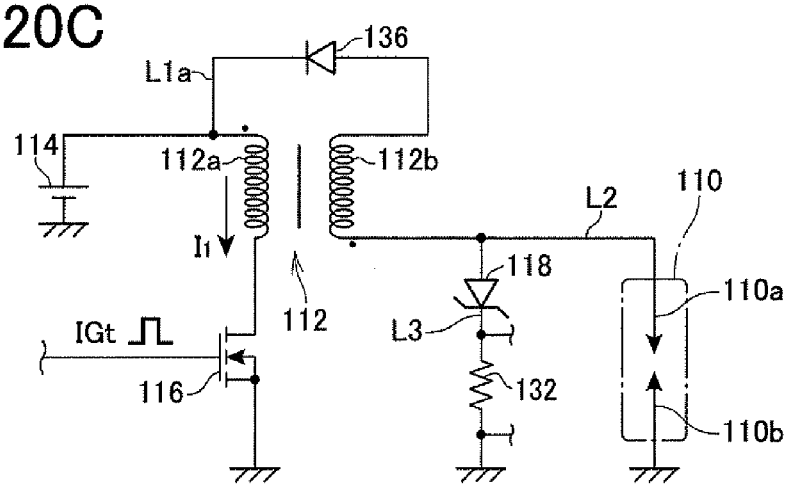

Further, in the circuit configuration of the seventh embodiment, the block diode may be arranged as follows. For example, as shown in FIG. 20B, a block diode 134 may be arranged between the secondary coil 112*b* and a portion where the constant-voltage path L3 is connected to the connecting path L2. Also, as shown in FIG. 20C, for example, a block diode 136 may be arranged in the low-voltage side path L1*a*.

Figure 21A:
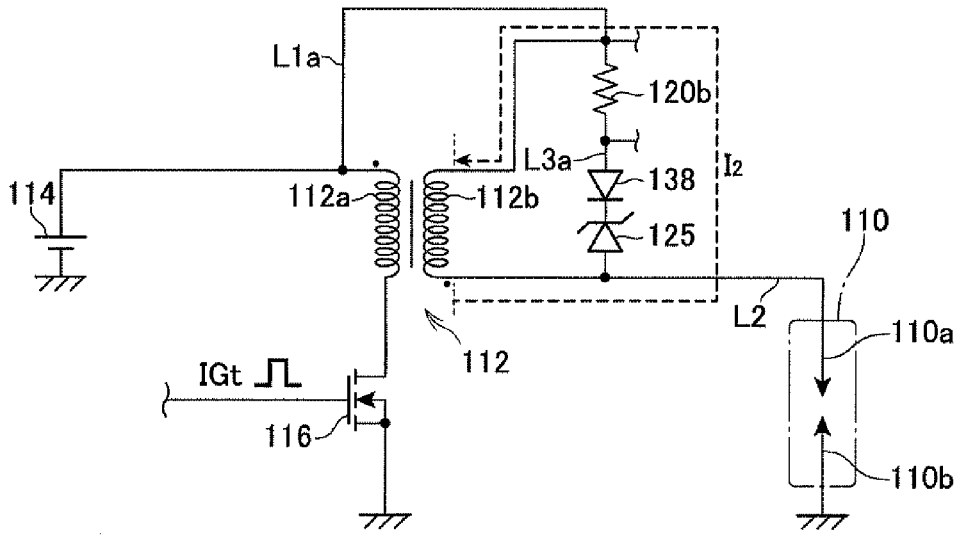
FIGS. 21A and 21B are diagrams illustrating ignition systems, according to a modification 4.
Figure 21B:
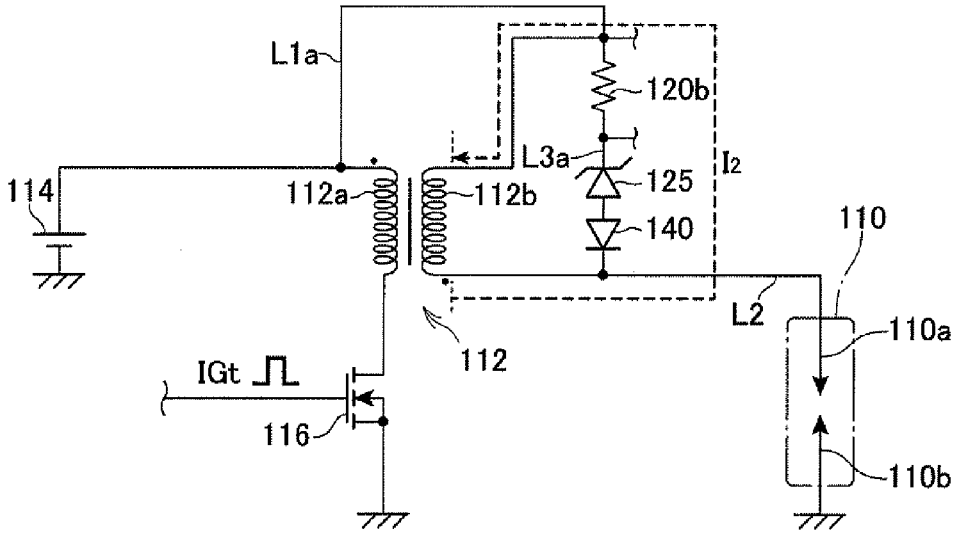

In the circuit configuration of the eighth embodiment, the block diode may be arranged in the constant-voltage path L3*a*. Specifically, for example, as shown in FIG. 21A, a block diode 138 may be arranged in the constant-voltage path L3*a* so as to be located between the resistor 120*b* and the Zener diode 125. More specifically, the block diode 138 may be arranged so that its anode is located so as to be connected to a resistor 120*b* and its cathode is located so as to be connected to a Zener diode 25. Further, for example, as shown in FIG. 21B, a block diode 140 may be arranged between a connecting path L2 and the Zener diode 125.

The resistor for detecting current may be arranged at a position other than the one shown in the third embodiment, if only the position is in the closed loop circuit that includes the secondary coil 112 and the constant-voltage path L3*a*.

The circuit configuration of the ignition system in each of the embodiments described above is based on what is called "negative discharge" in which discharge current flows from the ground electrode to the center electrode of the spark plug when the ignition signal IGt is switched off, with the center electrode serving as a negative pole and the ground electrode serving as a positive pole. However, the circuit configuration is not limited to this.

For example, the circuit configuration may be based on what is called "positive discharge" in which discharge current flows from the center electrode to the ground electrode when the ignition signal IGt is switched off, with the center electrode serving as a positive pole and the ground electrode serving as a negative pole.

In this case, instead of a configuration shown in FIG. 13, the secondary coil 112*b* has to be provided such that, when current is passed to the primary coil 112*a*, the polarity of one of two ends of the secondary coil 112*b*, which is connected to a center electrode 10*a*, will be negative and the polarity at another end of the secondary coil 112*b* will be positive.

In this case, the anode of the block diode 124 has to be connected to the secondary coil 12*b* and the cathode of the block diode 124 has to be connected to a center electrode 110*a* since current has to flow from one of two ends of the secondary coil 112*b*, which is connected to a spark plug 110, toward the low-voltage side path L1 when current is passed to the primary coil 112*a*.

Also, in this case, the anode of the Zener diode 118 has to be connected to the register 120 and cathode of the Zener diode 118 has to be connected to the connecting path L2.

The way of setting the breakdown voltage Vz of the Zener diode is not limited to the one exemplified in each of the fifth to the eighth embodiments. For example, the breakdown voltage Vz may be set to the upper-limit withstand voltage mentioned above. In this case, the Zener diode 118 does not exert the function of restricting the discharge voltage of the spark plug 110 until the discharge voltage reaches the upper-limit withstand voltage. If the open failure occurs before exertion of the restricting function, the discharge voltage may exceed the upper-limit withstand voltage to impair the reliability of the ignition system. Therefore, in this configuration as well, the failure determination process is effective.

The number of resistors for detecting current or the number of block diodes is not limited to one but may be two or more.

The current detecting means is not limited to a resistor. For example, the current detecting means may be a current sensor that uses a Hall element.

The switching element 116 is not limited to a MOSFET but may be a bipolar transistor, for example.

The constant-voltage element is not limited to the one exemplified in each of the embodiments described above. For example, the constant-voltage element may be an Avalanche diode that causes Avalanche breakdown when the voltage across its terminals becomes equal to a specified voltage. Alternatively, an element other than a Zener diode or an Avalanche diode may be used as the constant-voltage element if only the element has functions similar to those of the Zener or Avalanche diode.

The block diode is not limited to the one exemplified in each of the embodiments described above. For example, the block diode may be a Zener diode.

What is claimed is:

1. A control apparatus for an ignition system of an internal combustion engine, wherein the ignition system includes a spark coil having a primary coil and a secondary coil being electro-magnetically connected to the primary coil, and a spark plug that produces discharge sparks in between its center electrode and its ground electrode by applying a high voltage across both electrodes on the basis of the magnetic energy stored in the spark coil, comprising:

one of two ends of the secondary coil is connected to a member having a standard electric potential of the control apparatus via a low-voltage side path, and another end of the secondary coil is connected to the center electrode via a connecting path;

one of two ends of a constant-voltage path is connected to the connecting path while another end of the constant-voltage path is grounded, or both ends of the constant-voltage path is connected to a secondary coil;

the constant-voltage path includes a constant-voltage element, wherein the constant-voltage element, in an occasion where current is supplied to the primary coil, allows current to flow through the constant-voltage path in a specified direction that permits the polarity of the inductive voltage generated in the secondary coil to turn from negative to positive, and, in an occasion where current supplied to the primary coil is cut off and the voltage applied across the terminals of the element becomes equal to or higher than a specified voltage, allows current to flow through the constant-voltage path in a direction opposite to the specified direction and decreases voltage corresponds to the level of the specified voltage, and further includes a current detecting means which detects a current passing through the constant-voltage path; and the control apparatus includes a deterioration judging means that determines deterioration as being caused in the spark plug on the basis of the fact that a period in which the current is detected by the current detecting means has become longer than a predetermined standard period.

2. The control apparatus for an ignition system of an internal combustion engine according to claim 1, wherein the specified voltage is set to a voltage higher than a discharge voltage of a brand-new spark plug, and the deterioration judging means determines deterioration of the spark plug on the basis of the fact that current has been detected by the current detecting means.

3. The control apparatus for an ignition system of an internal combustion engine according to claim 2, wherein the control apparatus further includes an energy increasing means which increases an electric energy to be applied to the primary coil when the deterioration judging means has determined that the spark plug has deteriorated.

4. The control apparatus for an ignition system of an internal combustion engine according to claim 3, wherein the energy increasing means extends a current-supply period to the primary coil.

5. The control apparatus for an ignition system of an internal combustion engine according to claim 4, wherein the control apparatus further includes a control variable changing means which changes a control variable of a combustion-control actuator such that a discharge voltage of the spark plug would be reduced when the deterioration judging means has determined that the spark plug has been deteriorated.

6. The control apparatus for an ignition system of an internal combustion engine according to claim 5, wherein the control apparatus further includes a deterioration notification means which notifies user of a deterioration of the spark plug when the deterioration judging means has determined that the spark plug has been deteriorated.

7. The control apparatus for an ignition system of an internal combustion engine according to claim 6, wherein the constant-voltage element is comprised of a diode that causes Zener breakdown or Avalanche breakdown when the voltage applied across the terminals of the constant-voltage element becomes equal to the specified voltage.

8. The control apparatus for an ignition system of an internal combustion engine according to claim 1, wherein the control apparatus further includes an energy increasing means which increases an electric energy to be applied to the primary coil when the deterioration judging means has determined that the spark plug has deteriorated.

9. The control apparatus for an ignition system of an internal combustion engine according to claim 8, wherein the control apparatus further includes a control variable changing means which changes a control variable of a combustion-control actuator such that a discharge voltage of the spark plug would be reduced when the deterioration judging means has determined that the spark plug has been deteriorated.

10. The control apparatus for an ignition system of an internal combustion engine according to claim 9, wherein the control apparatus further includes a deterioration notification means which notifies user of a deterioration of the spark plug when the deterioration judging means has determined that the spark plug has been deteriorated.

11. The control apparatus for an ignition system of an internal combustion engine according to claim 10, wherein the constant-voltage element is comprised of a diode that causes Zener breakdown or Avalanche breakdown when the voltage applied across the terminals of the constant-voltage element becomes equal to the specified voltage.

12. A control apparatus for an ignition system of an internal combustion engine, wherein the ignition system includes a spark coil having a primary coil and a secondary coil being electro-magnetically connected to the primary coil, and a spark plug that produces discharge sparks in between its center electrode and its ground electrode by applying a high voltage across both electrodes on the basis of the magnetic energy stored in the spark coil, comprising:

one of two ends of the secondary coil is connected to the center electrode via a connecting path, while another end of the secondary coil is grounded via a low-voltage side path or connected to a member having a standard electric potential via a low-voltage side path;

one of two ends of a constant-voltage path is connected to the connecting path, wherein another end of the constant-voltage path is grounded or connected to a secondary coil; and the constant-voltage path includes a constant-voltage element, wherein the constant-voltage element, in an occasion where current is supplied to the primary coil, allows current to flow through the constant-voltage path in a specified direction that permits the polarity of the inductive voltage generated in the secondary coil to turn from negative to positive, and, in an occasion where current supplied to the primary coil is cut off and the voltage applied across the terminals of the element becomes equal to or higher than a specified voltage, allows current to flow through the constant-voltage path in a direction opposite to the specified direction and decreases voltage corresponds to the level of the specified voltage;

wherein the control apparatus further includes a current detecting means which detects a current passing through the constant-voltage path in the specified direction when current is supplied to the primary coil, and an open failure judging means which determines the occurrence of an open failure in the constant-voltage path on the basis of the fact that no current has been detected by the current detecting means when current is supplied to the primary coil.

13. The control apparatus for an ignition system of an internal combustion engine according to claim 12, wherein the ignition system further includes a restricting element which i) blocks the current to be passed through the constant-voltage path in the specified direction when the voltage across the terminals of the element becomes smaller than a threshold voltage, ii) allows the current to pass through the constant-voltage path in the specified direction when the voltage across the terminals becomes equal to or larger than the threshold voltage, and iii) allows current to pass through the constant-voltage path in a direction opposite to the specified direction when the current supplied to the primary coil is cut off;

wherein the threshold voltage is set to a voltage smaller than a maximum value of the voltage applied across both terminals of the restricting element when current is supplied to the primary coil, but larger than zero.

14. The control apparatus for an ignition system of an internal combustion engine according to claim 13, wherein the control apparatus further includes a failure notification device which notifies user of an occurrence of an open failure when the open failure judging means has determined that the open failure has occurred in the control apparatus.

15. The control apparatus for an ignition system of an internal combustion engine according to claim 14, wherein the constant-voltage element is comprised of a diode that causes Zener breakdown or Avalanche breakdown when the voltage applied across the terminals of the constant-voltage element becomes equal to the specified voltage.

16. The control apparatus for an ignition system of an internal combustion engine according to claim 12, wherein the control apparatus further includes a failure notification device which notifies user of an occurrence of an open failure when the open failure judging means has determined that the open failure has occurred in the control apparatus.

17. The control apparatus for an ignition system of an internal combustion engine according to claim 16, wherein the constant-voltage element is comprised of a diode that causes Zener breakdown or Avalanche breakdown when the voltage applied across the terminals of the constant-voltage element becomes equal to the specified voltage.

18. The control apparatus for an ignition system of an internal combustion engine according to claim 12, wherein the constant-voltage element is comprised of a diode that causes Zener breakdown or Avalanche breakdown when the voltage applied across the terminals of the constant-voltage element becomes equal to the specified voltage.

19. The control apparatus for an ignition system of an internal combustion engine according to claim 13, wherein the constant-voltage element is comprised of a diode that causes Zener breakdown or Avalanche breakdown when the voltage applied across the terminals of the constant-voltage element becomes equal to the specified voltage.

* * * * *